United States Patent [19]

Takahashi et al.

[11] Patent Number: 4,766,056

[45] Date of Patent: Aug. 23, 1988

[54] LIGHT-SENSITIVE MATERIAL WITH COMPOUNDS REACTIVE WITH DYE DEVELOPERS

[75] Inventors: Osamu Takahashi; Koichi Koyama; Keizo Koya, all of Kanagawa, Japan

[73] Assignee: Fuji Photo Film Co., Ltd., Kanagawa, Japan

[21] Appl. No.: 831,675

[22] Filed: Feb. 21, 1986

[30] Foreign Application Priority Data

| | | | |
|---|---|---|---|
| Feb. 21, 1985 | [JP] | Japan | 60-33491 |
| Apr. 2, 1985 | [JP] | Japan | 60-69716 |
| May 29, 1985 | [JP] | Japan | 60-116149 |

[51] Int. Cl.[4] ..... G03C 7/26; G03C 5/54

[52] U.S. Cl. ..... 430/351; 430/203; 430/214; 430/224; 430/225; 430/243; 430/551; 430/559

[58] Field of Search ..... 430/203, 214, 216, 224, 430/225, 243, 372, 543, 551, 557, 559, 351, 617

[56] References Cited

U.S. PATENT DOCUMENTS

| | | | |
|---|---|---|---|
| 2,983,606 | 5/1961 | Rogers | 430/224 |
| 3,173,786 | 3/1965 | Green et al. | 430/224 |
| 3,502,468 | 3/1970 | Rogers | 430/224 |
| 3,578,447 | 5/1971 | Simon | 430/224 |
| 4,511,643 | 4/1985 | Toya | 430/551 |
| 4,547,452 | 10/1985 | Toya | 430/372 |

*Primary Examiner*—Richard L. Schilling
*Attorney, Agent, or Firm*—Sughrue, Mion, Zinn, Macpeak, and Seas

[57] ABSTRACT

A heat-developable color light-sensitive material is disclosed, comprising a support having thereon at least one layer containing a light-sensitive silver halide, a binder, a compound containing a color moiety represented by formula (A), and a compound or a precursor thereof which reacts with an oxidized compound formed from the compound of formula (A), thereby converting the oxidized compound into a non-diffusible form, said compound of formula (A) being represented by (A)

wherein $R_1$, $R_2$, and $R_3$ each represents a hydrogen atom, an alkyl group, a cycloalkyl group, an aryl group, an aralkyl group, an alkoxy group, an aryloxy group, an acylamino group, an alkylthio group, an arylthio group, or a halogen atom, provided that at least one of $R_1$, $R_2$, and $R_3$ represents a hydrogen atom; X represents a chemical bond or a divalent linking group; Dye represents an image-forming dye moiety, and G represents a hydroxyl group or a group capable of forming a hydroxyl group upon heating and/or by the action of a base.

The material provides an image having a low minimum density in highlight areas, and excellent color separation and image preservability.

7 Claims, No Drawings

LIGHT-SENSITIVE MATERIAL WITH COMPOUNDS REACTIVE WITH DYE DEVELOPERS

FIELD OF THE INVENTION

This invention relates to a color light-sensitive material and, more particularly, it relates to a color light-sensitive material using a dye developer.

BACKGROUND OF THE INVENTION

Known photographic processes for obtaining a color positive image by using dye developers, i.e., compounds having a hydroquinone type developing agent moiety and a dye moiety in their molecule, include the wet development process as disclosed in U.S. Pat. Nos. 2,983,606, 3,415,644, and 3,594,164, etc., and the heat development process as disclosed in Japanese Patent Application (OPI) No. 165054/84 (the term "OPI" as used herein means a "published unexamined patent application"). That is, when a light-sensitive element which has been imagewise exposed is developed with a dye developer, the dye developer is immobilized in the developed areas. The dye developer which remains mobile is then transferred to an image-receiving element to thereby form a positive image. It is believed that the dye developer is immobilized through formation of an oxidized product upon exposure to light and, thus, substantially inhibited from transferring.

However, the above-described color photographic process using the dye developer is sometimes unsatisfactory in inhibition of transfer. As a result, the highlight portion that should become white may have higher density than desired, i.e., a higher minimum density, thus undesirable poor color separation may occur.

U.S. Pat. No. 3,173,786 discloses that transfer of an oxidized product of a dye developer can be suppressed by using an onium compound. However, it has been found that the onium compound not only causes desensitization of a light-sensitive element, but also reduces image density, particularly in a process using heat development.

SUMMARY OF THE INVENTION

Accordingly, an object of this invention is to provide a color light-sensitive material which provides an image having a high image density and a sufficiently low minimum density, and which is excellent in color separation.

The above object of this invention can be achieved by a color light-sensitive material having at least a light-sensitive silver halide, a binder, a compound containing a color moiety represented by formula (A) described below, and a compound or a precursor thereof which reacts with an oxidized compound formed from the compound of formula (A), thereby converting the oxidized compound into a non-diffusible form.

The compound of formula (A) containing a color moiety is represented by formula (A)

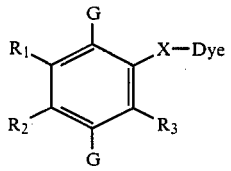

(A)

wherein $R_1$, $R_2$, and $R_3$ each represents a hydrogen atom, an alkyl group, a cycloalkyl group, an aryl group, an aralkyl group, an alkoxy group, an aryloxy group, an acylamino group, an alkylthio group, an arylthio group, or a halogen atom; with proviso that at least one of $R_1$, $R_2$, and $R_3$ represents a hydrogen atom; X represents a chemical bond or a divalent linking group between the benzene ring and the Dye moiety; Dye represents an image-forming dye moiety; and G represents a hydroxyl group or a group capable of forming a hydroxyl group upon heating and/or by the action of a base.

DETAILED DESCRIPTION OF THE INVENTION

The compound according to the present invention brings about great improvement in highlight areas of a transferred image, i.e., a reduced minimum density to remarkably improve discrimination. In a color image forming process by using dye developers, a main cause of coloration in the minimum density area, it is believed, is that an oxidized product of a dye developer (i.e., quinone compound) that should naturally be immobile is further reacted with various additives or decomposition products of additives, e.g., bases, that are present in the film, to be partly converted to mobile compounds, which are then transferred to a dye-fixing layer. The compound according to the present invention preferentially undergoes reaction (probably an addition reaction) with an oxidized product of a dye developer than other additives, e.g., bases, to thereby convert the dye developer oxidized product to a compound that is substantially less mobile, and preferably a ballasted compound. As a result, the minimum density is effectively lowered.

The compounds having the above-described function include the compounds represented by formulae (I), (II), and (III), as described below.

Formula (I) is represented by $$R_4SO_2M \qquad (I)$$

wherein $R_4$ represents a substituted or unsubstituted alkyl group, a substituted or unsubstituted aryl group, a substituted or unsubstituted heterocyclic group; M represents a hydrogen atom, an ammonium ion, and a metal ion.

$R_4$ specifically includes a substituted or unsubstituted, straight chain or branched chain or cyclic alkyl group, e.g., a methyl group, an isobutyl group, a dodecyl group, an octadecyl group, etc., a substituted or unsubstituted aryl group, e.g., a phenyl group, a naphthyl group, etc., a substituted or unsubstituted heterocyclic group, preferably a 5- to 7-membered ring. The heterocyclic group may be a condensed bicyclic or a tricyclic ring which is formed with an aromatic ring such as a benzene ring, a naphthalene ring and the like. Examples of heterocyclic group include a pyridyl group, a pyrazolyl group, a pyrazolotriazolyl group, a quinolyl group, etc.

In formula (I), the alkyl, aryl or heterocyclic moiety for $R_4$ may have substituents, e.g., a halogen atom, a nitro group, an amino group, a hydroxyl group, an alkyl group, a cycloalkyl group, an allyl group, an aryl group, an acyl group, an acylamino group, a carbamoyl group, a sulfamoyl group, an alkoxy group, a sulfonyl group, etc. Two or more of these substituents may be present.

M in formula (I) represents a hydrogen atom, an ammonium ion, or a metal ion, e.g., $Na^+$, $K^+$, $Mg^{2+}$. When M is a divalent or higher valent metal ion, the numbers of the $SO_2$ group and M are decided so that they are of the same charge. One or more $—SO_2M$ groups may be present in the molecule, but a preferred number of $—SO_2M$ groups is 1 or 2.

Of the compounds represented by formula (I), particularly preferred compounds are represented by formula (I-a)

(I-a)

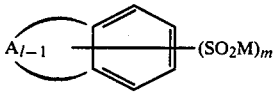

wherein A represents an atomic group forming a substituted or unsubstituted aromatic or heterocyclic ring condensed with the benzene ring; M represents a hydrogen atom, an ammonium ion, or a metal ion; l represents 1 or 2; and m represents an integer of 1 or more.

In the above-described formula (I-a), the condensed aromatic or heterocyclic ring formed by A includes a naphthalene ring, a quinoline ring; an indole ring, a benzothiophene ring, and the like.

The aromatic or heterocyclic ring may have two or more substituents, such as a halogen atom, a nitro group, an amino group, a hydroxyl group, an alkyl group, a cycloalkyl group, an aryl group, an acyl group, an acylamino group, a carbamoyl group, a sulfamoyl group, an alkoxy group, etc.

It is preferable that the compound represented by formula (I-a) is highly hydrophobic in order to efficiently immobilize an oxidized product of a dye developer, probably through addition reaction thereto. Therefore, the preferred among the compounds represented by the formula (I-a) are those in which the benzene ring or the aromatic or heterocyclic ring is substituted with a substituent or substituents, as recited above, having 3 or more total carbon atoms, and more preferably 6 or more total carbon atoms.

Specific examples of the compounds represented by formula (I-a) which are useful in the present invention are shown below, but the present invention is not limited thereto.

I-1

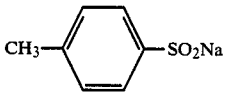

I-2

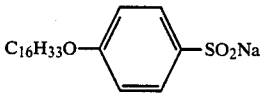

I-3

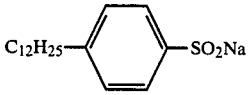

I-4

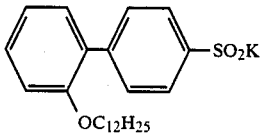

-continued

I-5

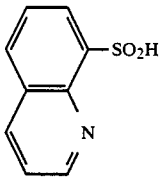

I-6

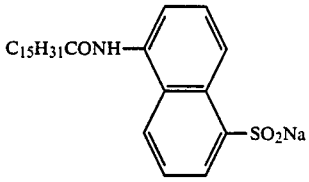

I-7

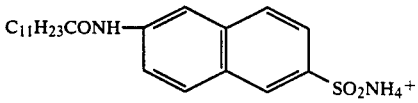

I-8

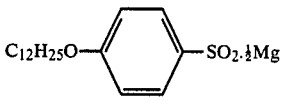

I-9

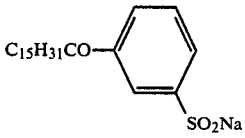

I-10

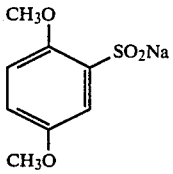

I-11

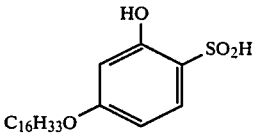

I-12

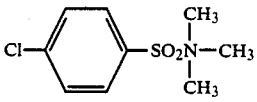

I-13

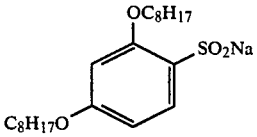

I-14

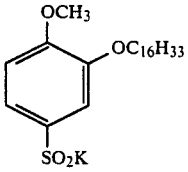

-continued
I-15
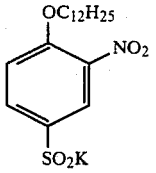
I-16
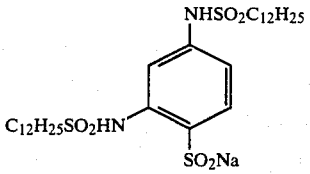
I-17
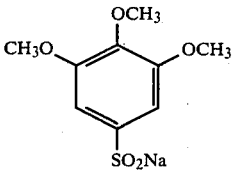
I-18
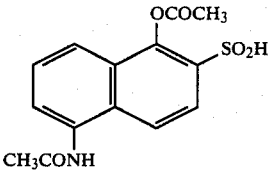
I-19
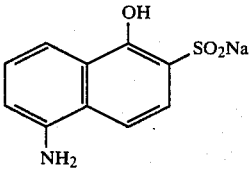
I-20
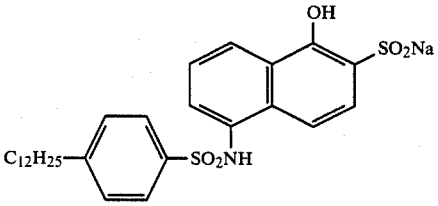
I-21
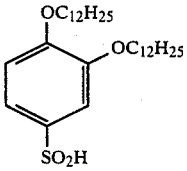
I-22
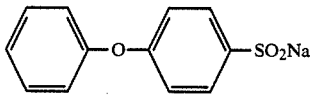
I-23
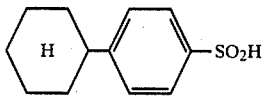
-continued
I-24
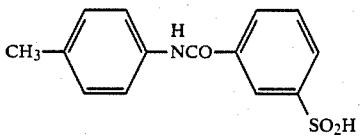
I-25
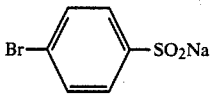
I-26
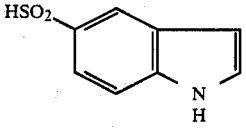
I-27
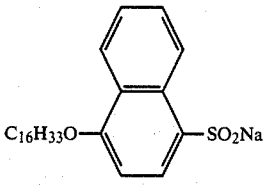
I-28
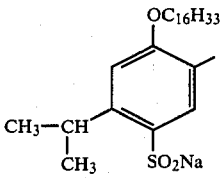
I-29
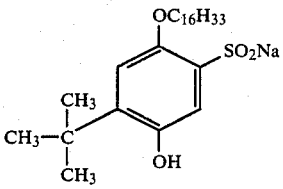
I-30
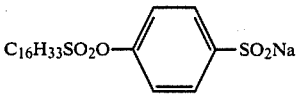
I-31
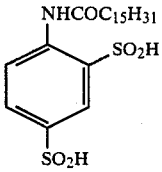
I-32
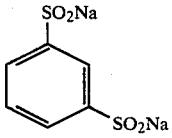
I-33
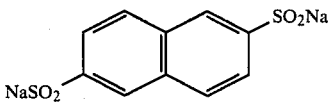

-continued

I-34

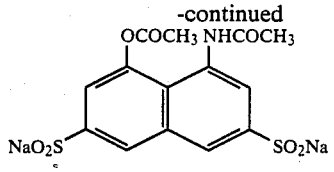

I-35

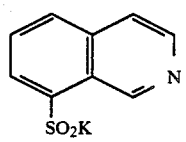

I-36

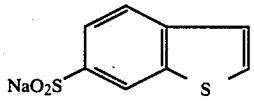

I-37

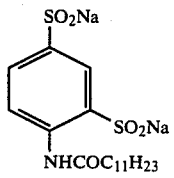

I-38

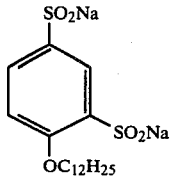

The compounds of formula (I) according to the present invention can easily be synthesized by known processes, as described, e.g., in S. R. Sandler and W. Karo, *General Synthesis of Sulfinic Acids, Organic Functional Group Preparations,* p. 519, Academic Press (1968).

The compound represented by formula (II) as described below is also useful in the present invention.

It appears that compounds of formula (II) release a sulfinic acid compound during the developing process, and that the released compound preferentially undergoes reaction (probably addition reaction) with an oxidized product of a dye developer than other additives, e.g., bases present in the film to thereby convert the dye developer oxidized product to a compound that is substantially less mobile, and preferably a ballasted compound. As a result, the minimum density would effectively be lowered.

Formula (II) is represented by

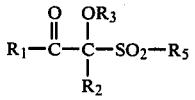

(II)

wherein $R_1$ represents a hydrogen atom, an alkyl group, preferably a straight chain or branched chain or cyclic alkyl group such as a methyl group, an ethyl group, a t-butyl group, an amyl group, a cyclohexyl group, etc., an aryl group preferably having from 6 to 30 carbon atoms such as a phenyl group, a naphthyl group, etc., or a heterocyclic group, preferably a 5- to 7-membered ring. The heterocyclic ring may be a condensed bicyclic or a tricyclic ring, and the condensed ring includes an aromatic ring such as a benzene ring, a naphthalene ring, and the like. Examples of heterocyclic group include a pyridyl group, a pyrimidyl group, an indolyl group, an isoquinolyl group, etc.

The alkyl, aryl, or heterocyclic group may have substituents, such as a halogen atom, a nitro group, an amino group, a hydroxyl group, a carboxyl group, an alkyl group, a cycloalkyl group, an aryl group, an acyl group, an acylamino group, a carbamoyl group, a sulfamoyl group, an alkoxy group, etc. Two or more of these substituents may be present.

$R_2$ in formula (II) represents a hydrogen atom, preferably a chlorine atom and a bromine atom, an alkyl group, preferably a straight chain or branched chain alkyl group having from 1 to 20 carbon atoms, such as a methyl group, an ethyl group, a propyl group, an isopropyl group, etc., an aryl group preferably having from 6 to 30 carbon atoms, such as a phenyl group, a naphthyl group, etc., an acyloxy group, preferably having a substituted or unsubstituted alkyl group or an aryl group having from 1 to 30 carbon atoms, such as an acetoxy group, etc., or a sulfonyl group preferably having a substituted or unsubstituted alkyl group or a substituted or unsubstituted aryl group having from 1 to 30 carbon atoms, such as a benzenesulfonyl group, a tosyl group, etc.

The alkyl or aryl group may be substituted, and examples of substituents include a halogen atom, a nitro group, an amino group, a hydroxyl group an alkyl group, a cycloalkyl group, an aryl group, an acyl group, an acylamino group, a carbamoyl group, a sulfamoyl group, an alkoxy group, etc.

$R_3$ of formula (II) represents a hydrogen atom or a group capable of being hydrolyzed such as

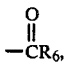

wherein $R_6$ represents a hydrogen atom, a straight or branched chain alkyl group having from 1 to 20 carbon atoms, such as a methyl group, an ethyl group, a t-butyl group, a pentadecyl group, etc., an aryl group having from 6 to 30 carbon atoms, such as a phenyl group, a naphthyl group, etc., an acyl group having from 1 to 20 carbon atoms, such as a benzoyl group, a stearoyl group, etc., or an alkoxy group having from 1 to 20 carbon atoms, such as a methyl group, an ethoxy group, etc.

The alkyl group or aryl group for $R_6$ in formula (II) may be substituted, and examples of substituents include a halogen atom, a nitro group, an amino group, a hydroxyl group, an alkyl group, a cycloalkyl group, an aryl group, an allyl group, an acyl group, an acylamino group, a carbamoyl group, a sulfamoyl group, an alkoxy group, etc. Two or more of these substituents may be present.

$R_5$ in formula (II) represents a substituted or unsubstituted alkyl group having a straight chain, branched chain, or cyclic structure, such as a methyl group, an isobutyl group, a dodecyl group, an octadecyl group, etc., a substituted or unsubstituted aryl group, such as a phenyl group, a naphthyl group, etc., or a substituted or unsubstituted heterocyclic group, preferably a 5- to 7-membered heterocyclic ring. The heterocyclic group may be a condensed bicyclo or a tricyclo ring, and the condensed ring includes an aromatic ring, such as a benzene ring, a naphthalene ring and the like, more specifically, e.g., a pyridine ring, a pyrazole ring, a pyrazolotriazole ring, a quinoline ring, etc.

The substituent for the alkyl moiety, aryl moiety, or heterocyclic moiety for $R_5$ includes a halogen atom, a nitro group, an amino group, a hydroxyl group, an alkyl group, a cycloalkyl group, an allyl group, an aryl group, an acyl group, an acylamino group, a carbamoyl group, a sulfamoyl group, an alkoxy group, etc. and may have two or more of such substituents.

It is preferable that the sulfinic acid compound released from the compound represented by formula (II) is highly hydrophobic in order to efficiently immobilize an oxidized product of a dye developer, probably through addition reaction thereto. Therefore, when $R_5$ in formula (II) is a benzene ring or an aromatic or heterocyclic ring, those preferred are substituted with a substituent or substituents, as recited above, having 3 or more total carbon atoms, and more preferably 6 or more total carbon atoms. When $R_5$ is an alkyl group, the preferred are substituted with a substituent or substituents having 6 or more total carbon atoms, including the above-described substituents.

Specific examples of compounds represented by the formula (II) which are useful in the present invention are shown below, but the present invention is not limited thereto.

II-1

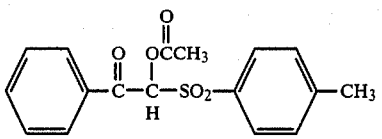

II-2

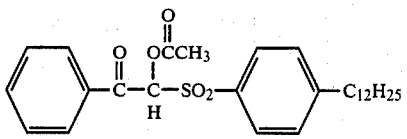

II-3

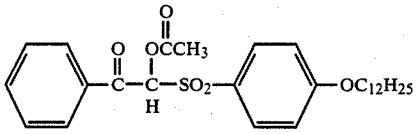

II-4

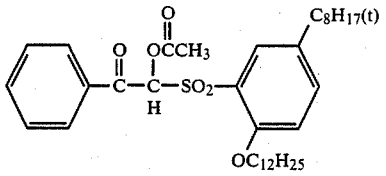

II-5

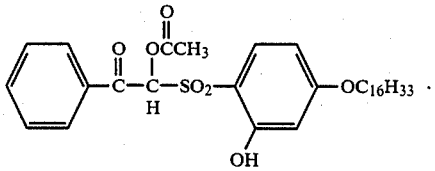

II-6

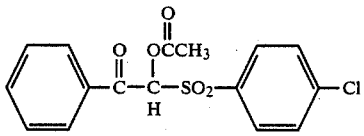

II-7

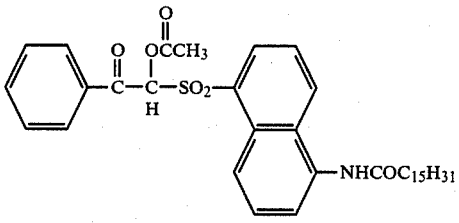

II-8

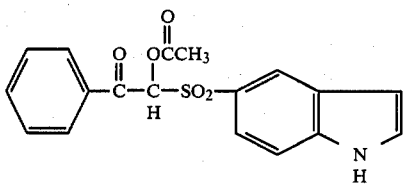

II-9

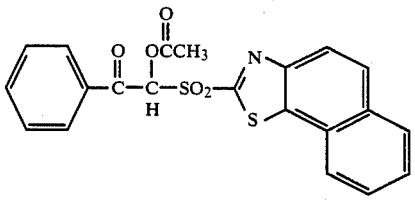

II-10

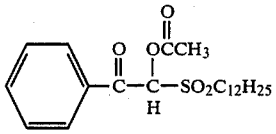

II-11

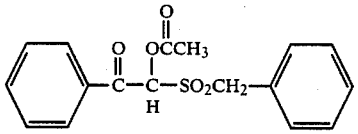

II-12

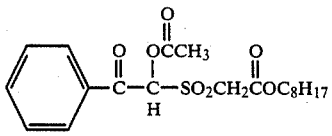

II-13

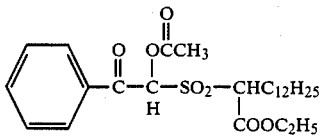

II-14

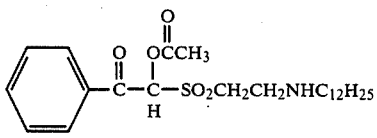

-continued
II-15
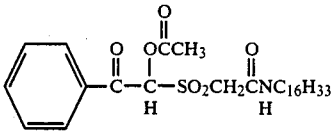
II-16
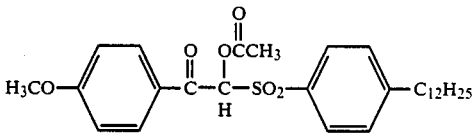
II-17
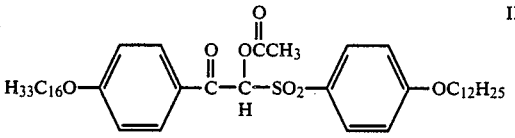
II-18
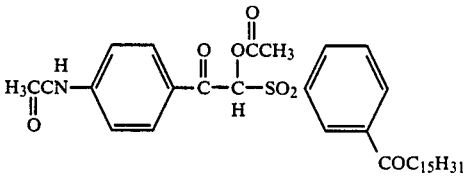
II-19
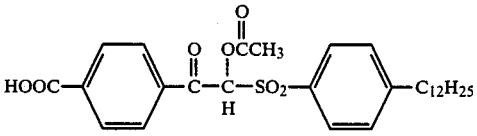
II-20
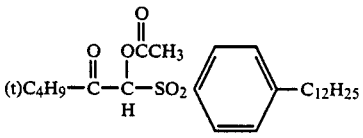
II-21
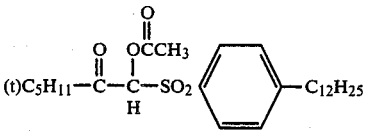
II-22
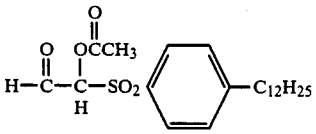
II-23
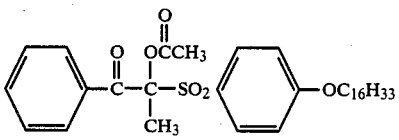
II-24
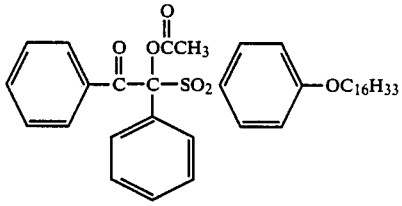
II-25
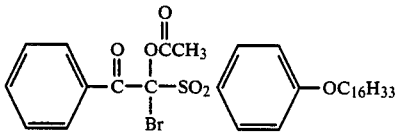
II-26
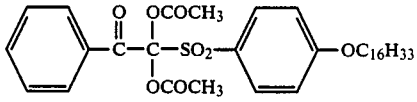
II-27
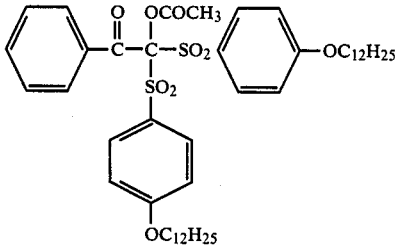
II-28
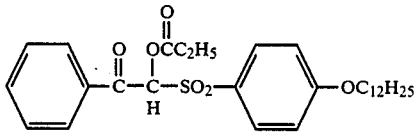
II-29
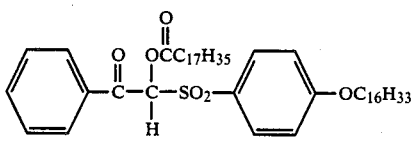
II-30
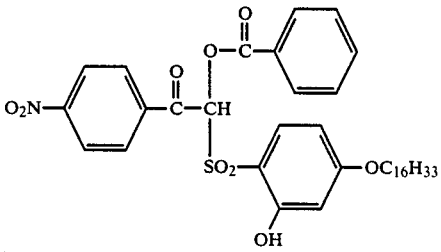

-continued
II-31
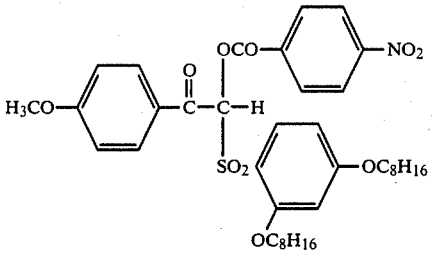
II-32
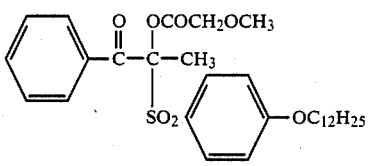
II-33
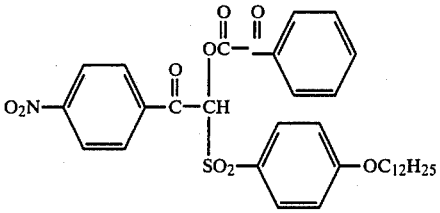
II-34
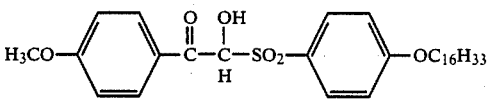
II-35
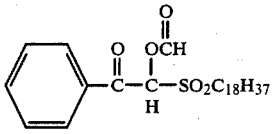
II-36
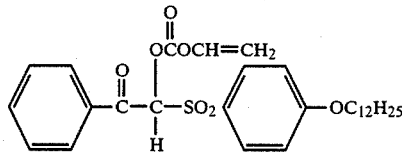
II-37
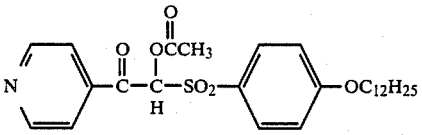
II-38
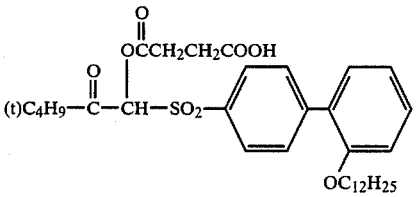
II-39
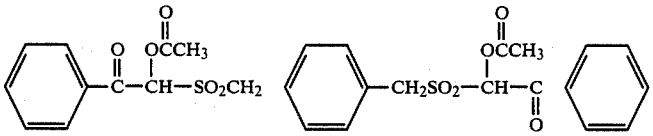
II-40
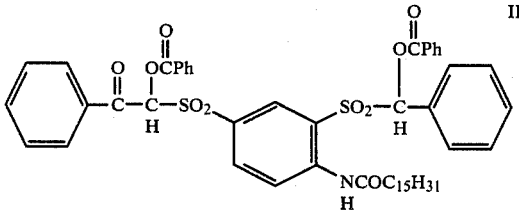
II-41
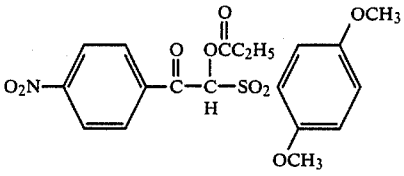
II-42
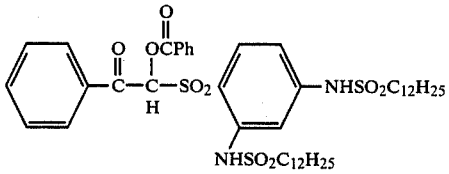
II-43
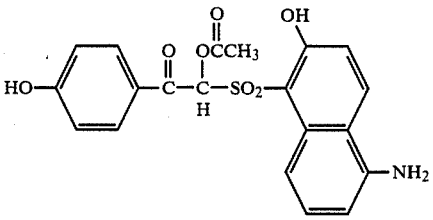
II-44
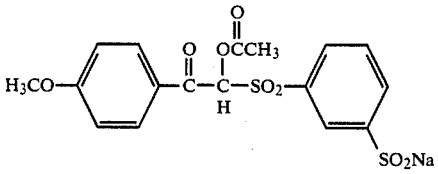

Specific examples of synthesizing the compound according to the present invention is described in detail below.

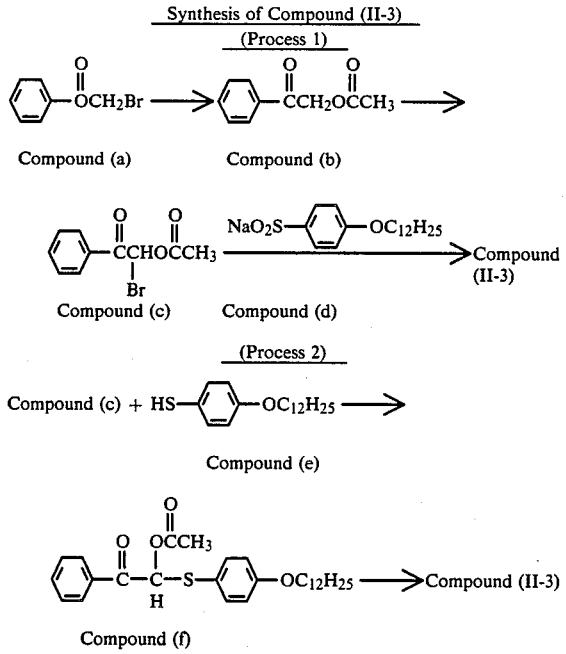

PROCESS 1

Synthesis of Compound (II)

In 300 ml of a mixed solvent of dimethylformamide and acetic acid (9:1 by volume) was dissolved 50 g of phenacylbromide (a), and 103 g of sodium acetate was added thereto. The reaction mixture was stirred at 40° C. for 2 hours, and added gradually to 2 liters of ice water. The resulting colorless crystals were collected by filtration to obtain 38 g of Compound (b) in a 85% yield.

Synthesis of Compound (c)

In 250 ml of acetic acid was dissolved 35 g of Compound (b), and 33 g of bromine was gradually added thereto dropwise at 50° C. under stirring. After dropwise addition, the reaction mixture was stirred for 1 hour, poured into ice water, and then extracted by chloroform. The extract was washed with water, dried over sodium sulfate and concentrated to obtain 41 g of oily Compound (c) in an 81% yield.

Synthesis of Compound (II-3)

20 g of Compound (c) was dissolved in 200 ml of tetrahydrofuran, and a solution of compound (d)* in a mixture of water and tetrahydrofuran was added to the solution of Compound (c) under stirring at room temperature.

*The sulfinic acid compound (d) used in synthesis of the compound according to the present invention can be synthesized by known processes as described, e.g., in S. R. Sandler and W. Karo, General Synthesis of Sulfinic Acids, Organic Functional Group Preparations, p. 519, Academic Press (1968).

After stirring at 40° C. for 1 hour, the mixture was poured into ice water and then the resulting crystals were collected by filtration. The crystals were dissolved in ethyl acetate, and the insoluble matter was separated by filtration. Ethyl acetate was distilled off under the reduced pressure. The thus-obtained residue was crystallized from ethanol to obtain 17.5 g of Compound (II-3) in a 45% yield having a melting point of 79°-81° C.

(PROCESS 2)

Synthesis of Compound (f)

29 g of Compound (e) was dissolved in 200 ml of dichloromethane and 19.7 ml of a 28% methanol solution containing sodium methoxide was added thereto. The mixture was stirred at room temperature for 30 minutes and 100 ml of dichloromethane solution containing 25 g of Compound (c) was added gradually thereto, and further stirred at room temperature for 30 minutes. The mixture was washed with water, dried over sodium sulfate, and concentrated. The residue obtained was subjected to column chromatography and extracted with a mixed solvent of hexane and ethyl acetate (5:1 by volume) to obtain 25.5 g of Compound (f) in a 55% yield.

Synthesis of Compound II-3

20 g of Compound (f) was dissolved in 300 ml of acetic acid, and 70 ml of a 35% hydrogen peroxide aqueous solution and a spoonful of sodium tungstate were added thereto. The mixture was stirred at 80° C. for 1 hour and was poured into ice water. After extraction with ethyl acetate, the extract was washed with water, dried over sodium sulfate, and concentrated. The residue was crystallized from methanol to obtain 18 g of Compound II-3 in a 84% yield.

Compounds represented by formula (III) are also useful as the compound which reacts with an oxidized compound formed from the compound of formula (A) to thereby convert the oxidized compound into a non-diffusible form.

Formula (III) is represented by

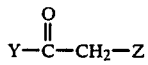

(III)

wherein Y represents an aliphatic group of an aromatic group; Z represents an electron-attractive group; with the proviso that at least one of Y and Z contains a non-diffusing group having from 6 to 30 carbon atoms.

Specific examples of Y in the above-described formula (III) include a substituted or unsubstituted alkyl group and a substituted or unsubstituted aryl group. Examples of the substituents include an alkyl group, an alkoxy group, an acylamino group, and the like.

Specific examples of Z in formula (III) include a cyano group, a nitrile group,

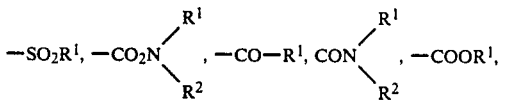

etc., wherein $R^1$ and $R^2$ each represents a hydrogen atom, a substituted or unsubstituted alkyl group having from 1 to 30 carbon atoms, or a substituted or unsubstituted aryl group having from 6 to 30 carbon atoms. The substituents for $R^1$ or $R^2$ include an alkyl group, an alkoxy group, a halogen atom, an oxycarbonyl group, a cyano group, a carboxyl group, a sulfo group, an acylamino group, etc.

Specific examples of the compounds of formula (III) which are useful in the present invention are shown below, but the present invention is not limited thereto.

III-1
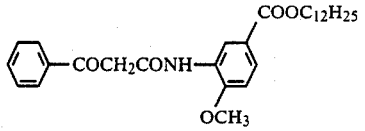

III-2
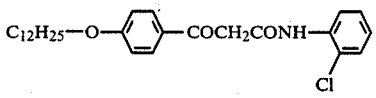

III-3
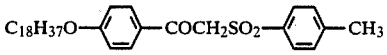

III-4
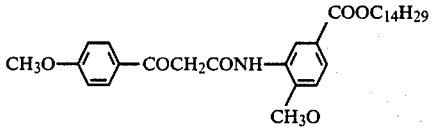

III-5
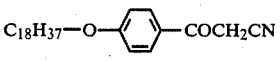

III-6
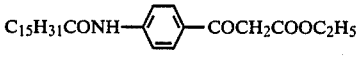

III-7
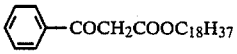

III-8
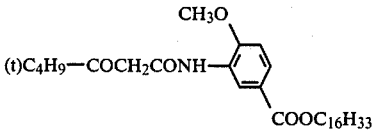

III-9
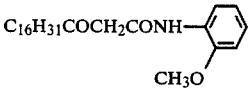

III-10
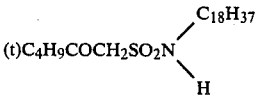

III-11
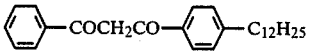

III-12
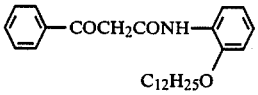

III-13
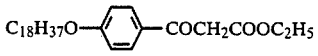

III-14
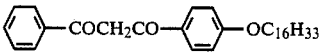

III-15
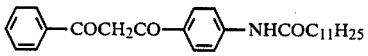

-continued

III-16
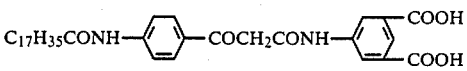

III-17
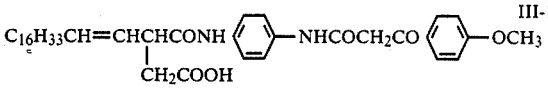

III-18
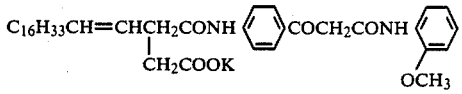

III-19
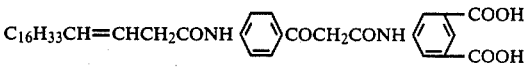

III-20
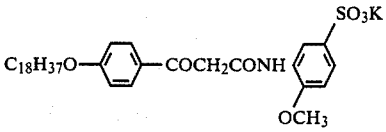

III-21
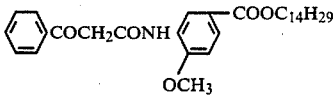

III-22
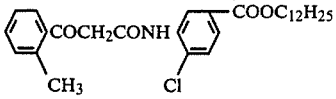

III-23
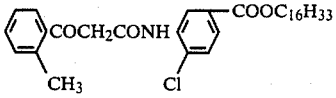

III-24
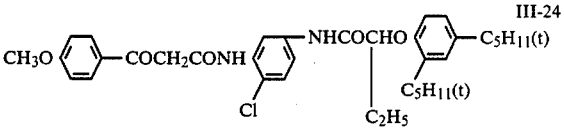

III-25
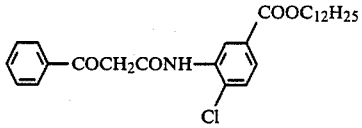

The compounds represented by formula (III) are known per se, and are readily available.

The compound can be used in widely ranging amounts, but, usually, in amounts ranging from 0.05 to 20 mols and preferably from 0.1 to 10 mols, per mole of a dye developer.

The compound according to the present invention can be incorporated in a light-sensitive coating by dissolving in a water-miscible organic solvent, e.g., methanol, ethanol, dimethylformamide, tetrahydrofuran, etc., either alone or in combination with water, and adding the solution to a light-sensitive coating composition. In this case, a dissolution aid, such as polyethylene type surface active agents, may be used. Incorporation of the compound according to the present invention can also be carried out by dissolving in a sparingly water insoluble organic solvent, e.g., ethyl acetate, tricresyl phosphate, dibutyl phthalate, etc., emulsifying the solution, and adding the emulsion to a light-sensitive coating composition. The solution may be emulsified either individually or together with a dye developer.

The compound according to the present invention which contains both a ballast group and a hydrophobic group in the molecule, thereby has a surface active property and forms a micelle, e.g., the above-described compound III-16 through III-20, can be added to a light-sensitive coating by dissolving the compound in water, a water-miscible organic solvent, e.g., methanol, ethanol, dimethylformamide, tetrahydrofuran, or a mixture of water and the above-described organic solvent and the like.

The compound according to the present invention may be present in any layers constituting the light-sensitive material, but is preferably present in the layer containing the dye developer of formula (A).

The dye developer represented by formula (A) is hereinafter described in detail.

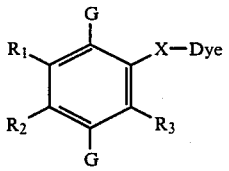

(A)

wherein $R_1$, $R_2$, and $R_3$ each represents a hydrogen atom, a substituted or unsubstituted alkyl group, a substituted or unsubstituted cycloalkyl group, a substituted or unsubstituted aryl group, a substituted or unsubstituted aralkyl group, a substituted or unsubstituted alkoxy group, a substituted or unsubstituted aryloxy group, an acylamino group, a substituted or unsubstituted alkylthio group, a substituted or unsubstituted arylthio group or a halogen atom; with proviso that at least one of $R_1$, $R_2$, and $R_3$ is a hydrogen atom; G represents a hydroxyl group or a group capable of forming a hydroxyl group upon heating or by the action of a base; X represents a chemical bond or a divalent linking group; and Dye represents an image forming dye moiety or a precursor thereof.

In formula (A), the substituent for the alkyl moiety or aryl moiety for $R_1$, $R_2$, and $R_3$ includes an alkoxy group, a hydroxyl group, a halogen atom, a cyano group, an acyloxy group, an alkoxycarbonyl group, an acylamino group, a carbamoyl group, a substituted carbamoyl group, a sulfamoyl group, a substituted sulfamoyl group, an alkylsulfonylamino group, an arylsulfonylamino group, a ureido group, and a substituted ureido group.

In a preferred embodiment according to the present invention, $R_1$, $R_2$, and $R_3$ are selected from a hydrogen atom, an alkyl group having up to 4 carbon atoms, an alkoxy group having up to 4 carbon atoms, and an alkylthio group having up to 4 carbon atoms; and G is a hydroxyl group or a precursor thereof selected from trialkylsilyl ethers, carboxylic esters, carbonic esters, sulfonic ester, and phosphoric esters of a hydroxyl group.

X preferably represents a chemical bond or a linking group, such as an alkylene group, $$-O-,\ -S-,\ -\overset{O}{\overset{\|}{C}}-,\ -SO_2-,\ -NHCO-,$$

-continued alkylene-NHCO—, alkylene-$NHSO_2$—, alkylene-$SO_2NH$—, alkylene-CONH—, —NHCONH—, 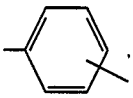 ,

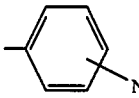

, 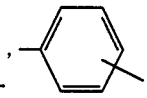

, or alkylene— 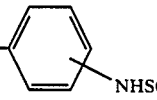

.

Dyes which can be used for the image-forming dye moiety as represented by Dye include azo dyes, azomethine dyes, anthraquinone dyes, naphthoquinone dyes, styryl dyes, nitro dyes, quinoline dyes, carbonyl dyes, phthalocyanine dyes, xanthene dyes, and the like, either chelated or nonchelated.

Examples of usable yellow dyes are described in U.S. Pat. Nos. 3,597,200, 3,309,199, 4,013,633, 4,245,028, 4,156,609, 4,139,383, 4,195,992, 4,148,641, 4,148,643, and 4,336,322, Japanese Patent Application (OPI) Nos. 114930/76 and 71072/81, *Research Disclosure,* RD No. 17630 (December 1978), ibid., RD No. 16475 (December 1977).

Examples of usable magenta dyes are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292; Japanese Patent Application (OPI) Nos. 106727/77, 23628/78, 36804/80, 73057/81, 71060/81, 134/80, 123538/81, and 113779/81.

Examples of usable cyan dyes are described in U.S. Pat. Nos. 3,482,972, 3,929,760, 4,013,635, 4,268,625, 4,171,220, 4,242,435, 4,142,891, 4,195,994, 4,147,544, and 4,148,642, British Pat. No. 1,551,138, Japanese Patent Application (OPI) Nos. 99431/79, 8827/77, 47823/78, 143323/78, 99431/79, and 71061/81, European Pat. (EPC) Nos. 53,037 and 53,040, Japanese Patent Application (OPI) No. 165054/84, *Research Disclosure,* RD No. 17630 (December 1978), ibid., RD No. 16475 (December 1977), etc.

Image-forming dyes are required to have hues suited for color reproduction, to have high molecular extinction coefficients, to be stable against light, heat, and dye-releasing acids and other additives present in the system, and to be easy to synthesize. Examples of the preferred image-forming dyes satisfying these requirements are described in Japanese Patent Application (OPI) No. 165054/84.

A dye capable of forming a metal chelate may be used to form a chelate dye in a dye-fixing layer containing a metal salt (after-chelating).

Dyes of this type are described, for example, in U.S. Pat. Nos. 4,250,238, 4,346,155, 4,346,161, 4,357,410, 4,357,412, 4,419,435, 4,420,550, 4,407,931, and 4,436,799, Japanese Patent Application (OPI) Nos. 35533/78, 53329/80, 146250/82, 58149/82, 158637/82, 58149/82, 185433/82, 146250/82, 185040/82, 158637/82, 185040/82, 158637/82, 185039/82, 182738/82, 181546/82, 163938/83, 123537/83, 163938/83, 17436/83, 17437/83, 17438/83, 209741/83, 209742/83, 48765/84, and 7950/84.
Specific examples of the dye developer which can be used in the present invention are shown below, but the present invention is not limited thereto.
(1)
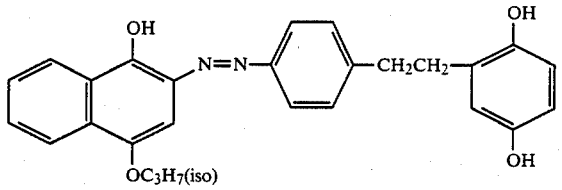
(2)
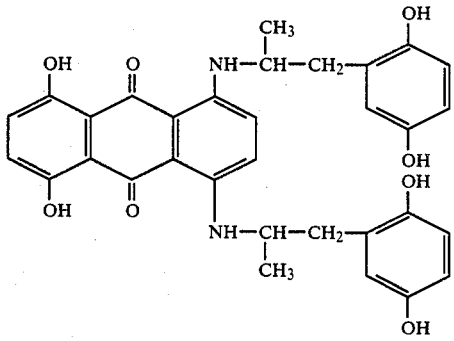
(3)
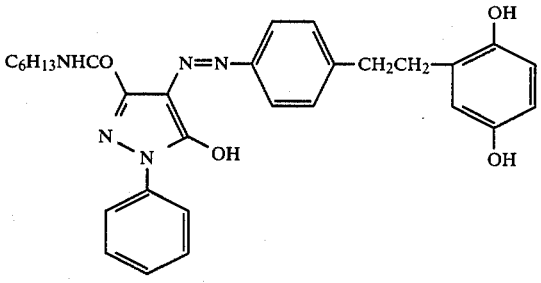
(4)
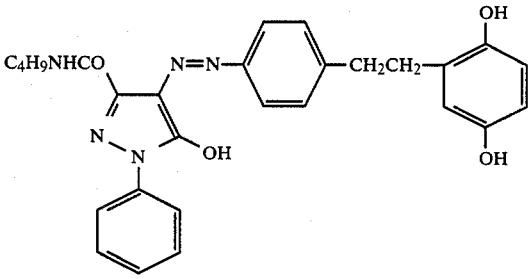
(5)
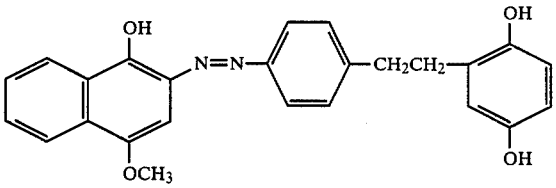
(6)
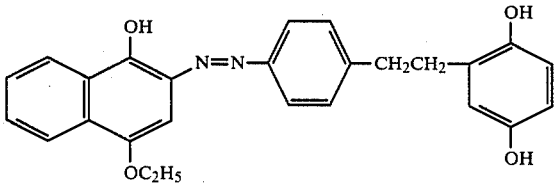

-continued
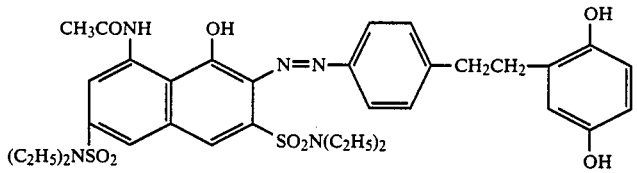
(7)
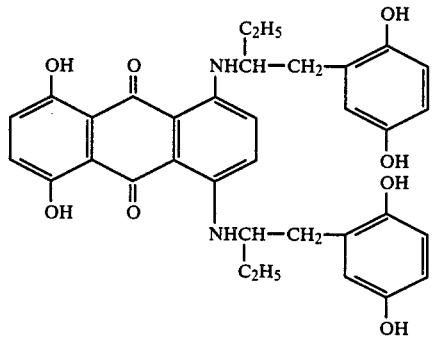
(8)
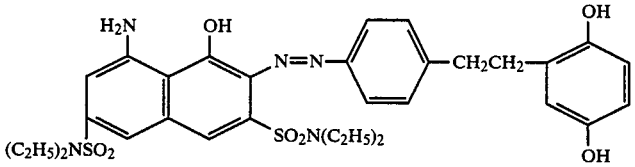
(9)
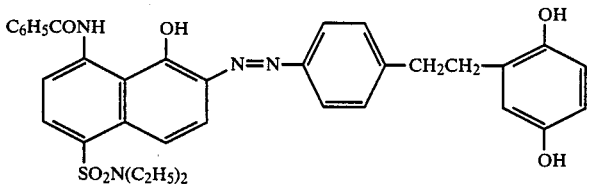
(10)
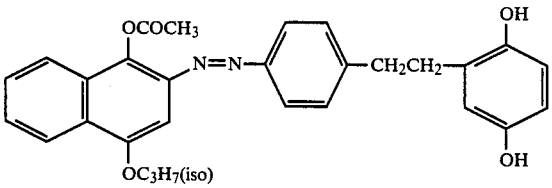
(11)
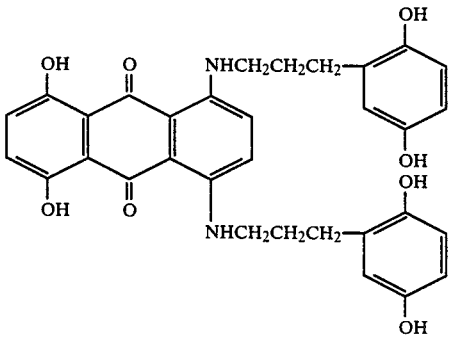
(12)

-continued
(13)
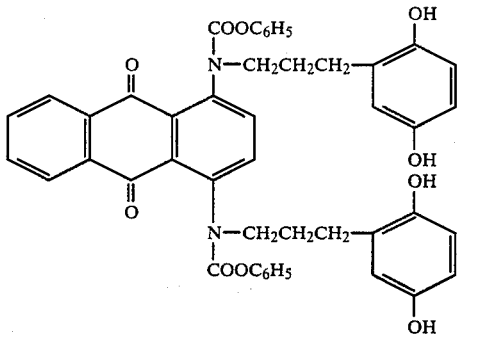
(14)
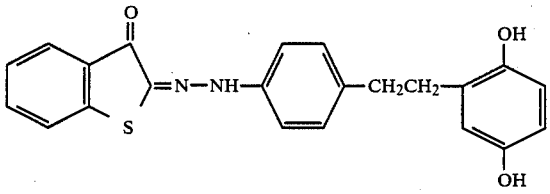
(15)
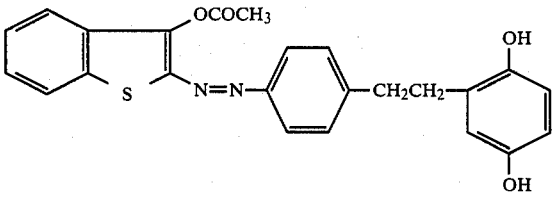
(16)
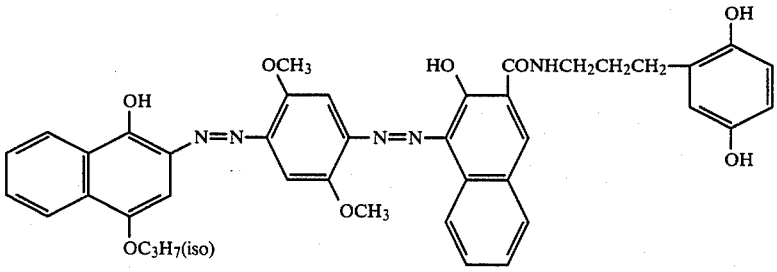
(17)
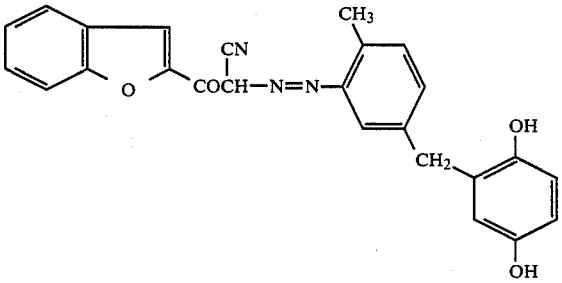
(18)
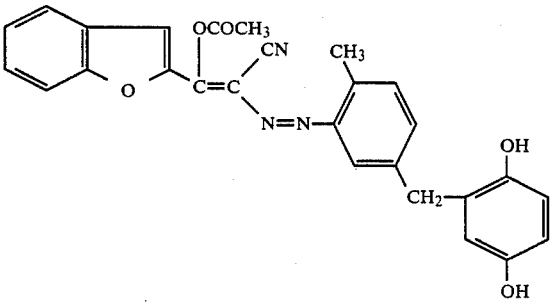

-continued
(19)
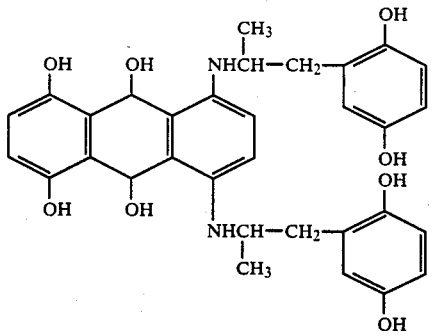
(20)
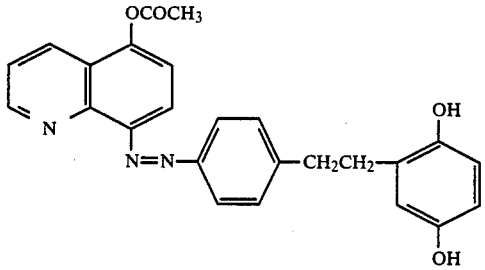
(21)
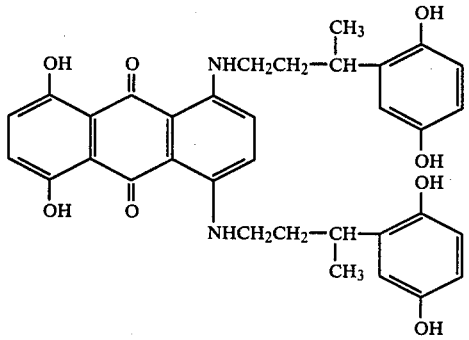
(22)
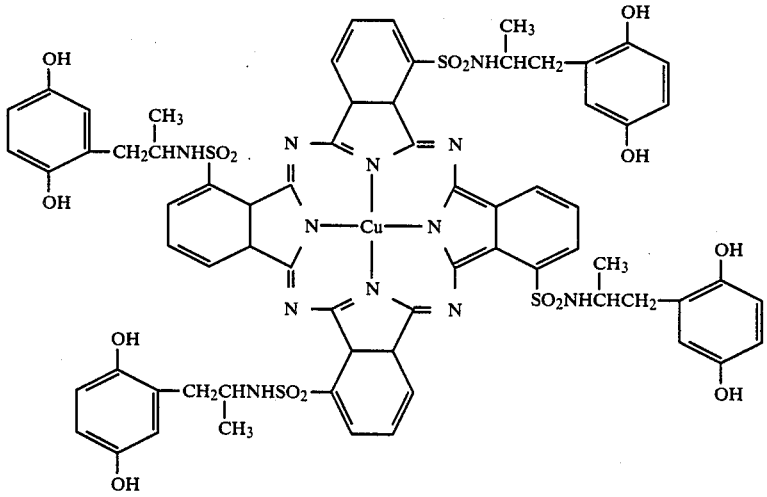
(23)
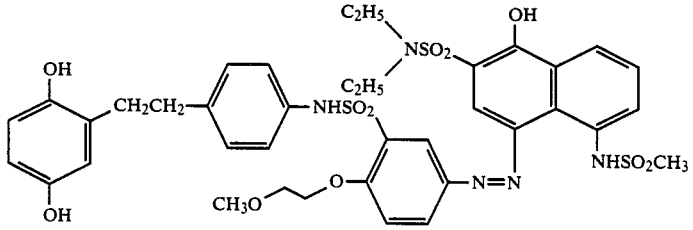

-continued
(24)
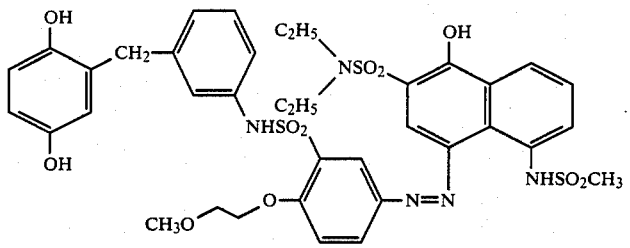
(25)
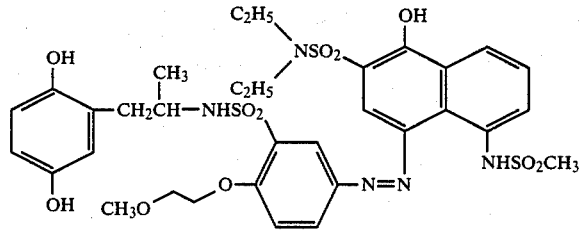
(26)
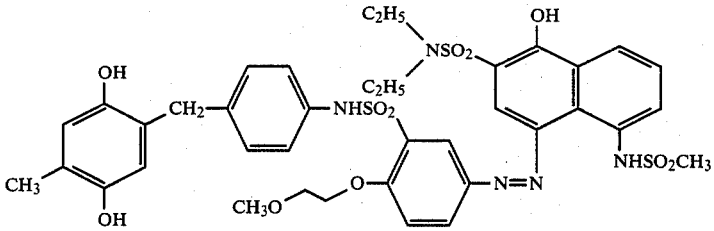
(27)
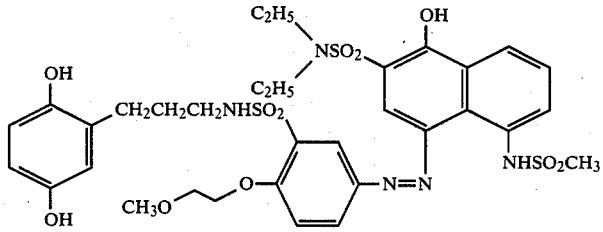
(28)
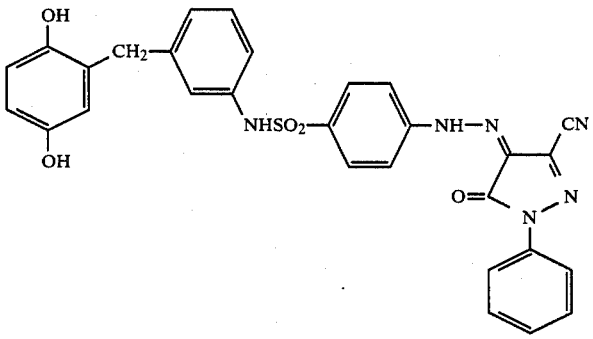
(29)
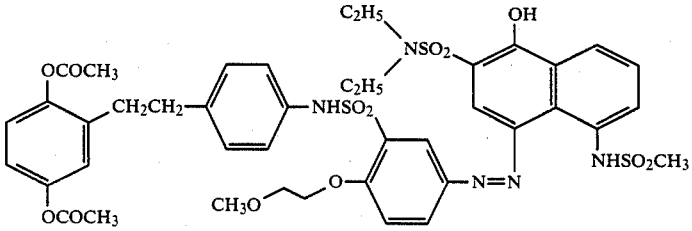

-continued
(30)
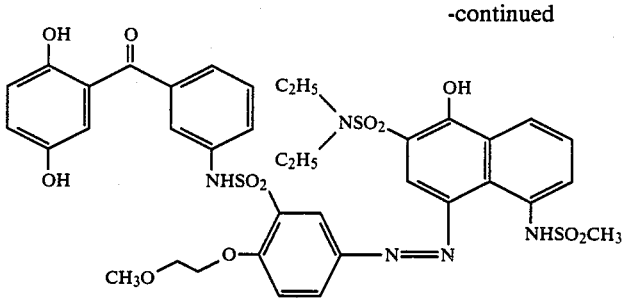
(31)
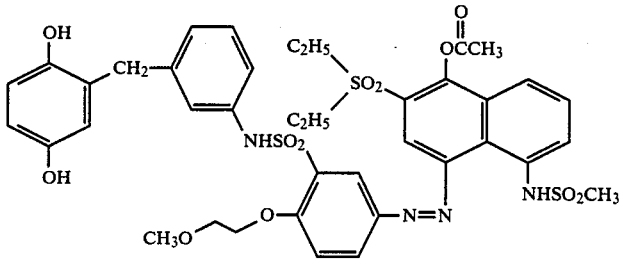
(32)
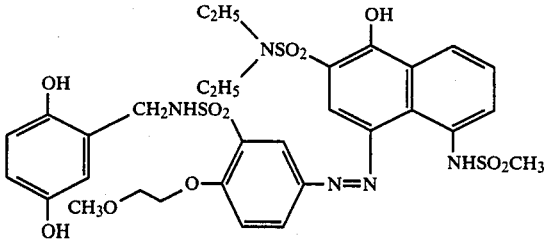
(33)
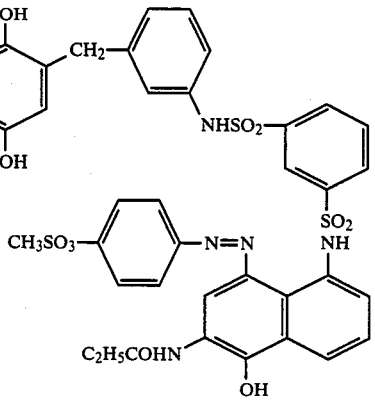
(34)
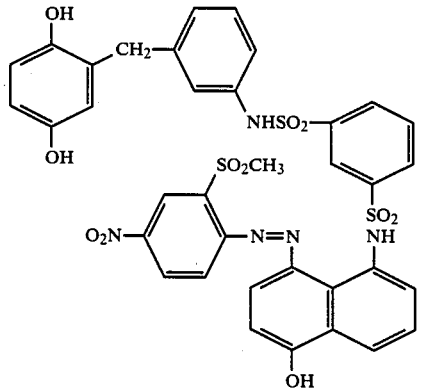
Processes for synthesizing dye developers are described in U.S. Pat. Nos. 3,134,764, 3,173,929, 3,929,848, 3,970,616, and 3,888,876, etc., and the dye developers which can be used in the present invention can be prepared in accordance with these processes.

The dye developers of the present invention may be used in combination of two or more thereof. In this case, two or more dye developers may be used to form a particular color, or to form a black color.

The dye developers of the present invention are preferably used in a total amount ranging from 10 mg to 15 g per $m^2$, and more preferably from 15 mg to 5 g per $m^2$.

The dye developers of this invention may be used either in the layer containing a silver halide emulsion or a layer adjacent to an emulsion layer.

In the present invention, a reducing agent is used, if desired. The reducing agent is a so-called auxiliary silver salt developer and is capable of accelerating silver developement in co-operation with the dye developer.

Useful auxiliary developers include hydroquinone, alkyl-substituted hydroquinones, e.g., tert-butylhydroquinone, 2,5-dimethylhydroquinone, etc., catechols, pyrogallols, halogen-substituted hydroquinones, e.g., dichlorohydroquinone, etc., alkoxy-substituted hydroquinones, e.g., methoxyhydroquinone, etc., polyhydroxybenzene derivatives, e.g., methylhydroxynaphthalene, etc., and the like. In addition, methyl gallate, ascorbic acid, ascorbic acid derivatives, hydroxylamines, e.g., N,N'-di-(2-ethoxyethyl)hydroxylamine, etc., pyrazolidones, e.g., 1-phenyl-3-pyrazolidone-4-methyl-4-hydroxymethyl-1-phenyl-3-pyrazolidone, etc., reductones, hydroxytetronic acid, and so on are also useful.

Of these, pyrazolidones are particularly advantageous in view of less stain and noticeable manifestation of the effects of the compounds of formula (I). These auxiliary developers may be precursors thereof that can be activated upon heating or by the action of a base.

The auxiliary developers are used in given concentrations. Preferred concentrations range from 0.0005 to 20 mols, and more preferably from 0.001 to 4 mols, per mol of silver.

The color light-sensitive material according to the present invention is preferably composed of a combination of a blue-sensitive emulsion layer, a green-sensitive emulsion layer, and a red-sensitive emulsion layer, or a combination of a green-sensitive emulsion layer, a red-sensitive emulsion layer, and an infrared-sensitive emulsion layer, each of these layers being combined with a yellow dye developer, a magenta dye developer and a cyan dye developer, respectively. The term "infrared-sensitive emulsion layer" used herein means an emulsion layer sensitive to light having wavelengths of 700 nm or more, and particularly preferably 740 nm or more.

Silver halides which can be used in this invention include silver chloride, silver chlorobromide, silver chloroiodide, silver bromide, silver iodobromide, silver chloroiodobromide, silver iodide, and the like.

Such silver halides, e.g., silver iodobromide, can be obtained, for example, by adding a silver nitrate solution to a potassium bromide solution to form silver bromide grains, and then adding potassium iodide thereto.

The silver halides may be mixtures of two or more kinds of silver halides having different sizes and/or silver halide compositions.

The silver halide grains to be used in this invention preferably have a mean grain size of from 0.001 to 10 μm, and more preferably from 0.001 to 5 μm.

These silver halides may be employed as formed, but, if desired, may be chemically sensitized with chemical sensitizers, such as compounds of sulfur, selenium, tellurium, etc., and compounds of gold, platinum, palladium, rhodium, iridium, etc.; reducing materials, such as tin halides; or mixtures thereof. Details for chemical sensitization are described, e.g., in T. H. James, *The Theory of the Photographic Process,* 4th Ed., Chapter 5, pp. 149–169, Macmillan Publishing Co., 1977.

The light-sensitive silver halide is generally suitable coated to a silver coverage of from 1 mg to 10 g per $Ag/m^2$.

Silver halide can be spectrally sensitized to specific wavelength regions with sensitizing dyes. Sensitizing dyes which can be used for spectral sensitization include cyanine dyes, merocyanine dyes, complex cyanine dyes, complex merocyanine dyes, holopolar cyanine dyes, hemicyanine dyes, styryl dyes, and hemioxonal dyes. Among them, preferred are cyanine dyes, merocyanine dyes, and complex merocyanine dyes. Any of nuclei commonly employed for cyanine dyes as basic heterocyclic nuclei may be applied to these dyes.

These sensitizing dyes may be used either individually or in combinations thereof. Combinations of sensitizing dyes are frequently used particularly for the purpose of supersensitization.

The silver halide emulsions may further contain, in combination with the sensitizing dyes, dyes which do not per se have spectral sensitizing activity, or substances which do not substantially absorb visible light, but which do show supersensitizing effects.

The color light-sensitive material according to the present invention can be applied to the so-called color diffusion transfer development using the developer at about room temperature and the heat-development by heating under a substantially non-water condition.

In such cases, the color light-sensitive material may be a film unit in combination with dye-fixing material (the image receiving element).

The typical structure of the film unit is that the above-described image-receiving element and the light-sensitive element are coated on a transparent support and it is not required to peel the light-sensitive material from the image-receiving element after the formation of transferred images. More specifically, the image-receiving layer containing at least one mordant layer and a white reflective layer containing a solid pigment such as titanium oxide, etc., is provided between said mordant layer and the light-sensitive layer or the layer containing the dye providing material so that the transferred images can be seen through the transparent support. The light-sensitive layer may be further provided between the white reflective layer and the light-sensitive layer so that development can be conducted in the bright room. If necessary, the peel-apart layer may be provided at the appropriate position so that all or a part of the light-sensitive layer can be peeled from the image-receiving layer, as described, e.g., in Japanese Patent Application (OPI) No. 67840/81 or Canadian Pat. No. 674,082.

In another case of where the film unit has a structure of the non-peel-apart type, the above-described light-sensitive element is coated on a transparent support and thereon the white reflective layer, and further thereon the image-receiving layer is coated.

The embodiment that the image-receiving layer, the white reflective layer, the peel-apart layer and the light-sensitive layer are coated on the same support, and that the light-sensitive layer is intentionally peeled from the image-receiving layer, is described in U.S. Pat. No. 3,730,718.

The film unit having the structure in which the light-sensitive element and the image-receiving element are coated on separate supports are classified into two large groups. One group includes those of the non-peel-apart type, and the other includes those of the peel-apart type. The above-described film units are hereinafter described in detail. In the preferred embodiment of the peel-apart type film unit, the light reflective layer is provided on the back side of the support, and at least one image-receiving layer is coated on the surface of the support. The light-sensitive element is coated on the support having the backing layer, and it is devised that the coated face of the light-sensitive layer is out of contact with the coated face of the mordant layer before conclusion of light exposure, but the light-sensitive layer is overturned to bring into contact with the coated face of the mordant layer after light exposure (e.g., during development). The light-sensitive layer is quickly peeled from the image-receiving layer after the transferred images are formed at the mordant layer.

On the other hand, in the preferred embodiment of the non-peel-apart type film unit, at least one mordant layer is coated on the transparent support and the light-sensitive layer is coated on the support having the transparent layer or the backing layer. The coated face of the light-sensitive layer is provided contact with the coated face of the mordant layer.

The film units having an above-described structure are applied to both of the color diffusion transfer process and the heat-development. In particular, the former may be conducted by using the container (the developable element) containing an alkaline developer, which is capable of rupturing under pressure. In the non-peel-apart type film unit having the structure in which the image-receiving layer and the light-sensitive layer are piled on the same support, the above-described developable element is preferably provided between the light-sensitive element and the cover sheets to be coated thereon. In the film unit having the structure in which the light-sensitive element and the image-receiving element are coated on the two separate support, the developable element is preferably provided between the light-sensitive element and the image-receiving element at the development at latest. The developable element is preferred to contain a backing agent (e.g., a dye whose color changes dependent on carbon black or a pH value, etc.) and/or a white pigment (e.g., titanium oxide, etc.), according to the structure of the film unit. The film unit used for the color diffusion transfer process preferably has a structure comprising the combination of a neutralizing layer and a neutralization timing layer, which has a function of neutralization, and such is incorporated in the cover sheet, the image-receiving element, or the light-sensitive element.

On the other hand, in the heat development, the above-described developer component is not required and silver halide causes to react with the dye developer by heating after exposure (e.g., from about 80° to about 250° C.).

The embodiment that the compound of the present invention is applied to the heat developable light-sensitive material is hereinafter described in detail.

In the case that the compound of the present invention is applied to the heat developable light-sensitive material, a silver organic salt is preferably used in combination. Silver organic salts which can be used are those which react with the above-described image-forming material, or, if necessary, the reducing agent to be present with the image-forming material when heated up to 80° C. or more, preferably 100° C. or more, in the presence of exposed silver halide. By using the oxidizing agent of a silver organic salt in combination, a light-sensitive material which forms high density color can be obtained.

Examples of the above-mentioned organic silver salt oxidizing agent are those described, e.g., in Japanese Patent Application (OPI) No. 58543/83 and include silver salts of organic compounds having a carboxyl group, such as aliphatic carboxylic acids and aromatic carboxylic acids; silver salts of compounds having a mercapto group or a thione group or derivatives thereof; silver salts of compounds having an imino group; silver salts of benzotriazole or derivatives thereof, e.g., benzotriazole, alkyl-substituted benzotriazoles (e.g., methylbenzotriazole), halogen-substituted benzotriazoles (e.g., 5-chlorobenzotriazole), carboimidobenzotriazoles (e.g., butylcarboimidobenzotriazole), etc., as described in Japanese Patent Publication Nos. 30270/69 and 18416/70; a silver salt of 1,2,4-triazole or 1-H-tetrazole as described in U.S. Pat. No. 4,220,709; a silver salt of saccharine; silver salts of imidazole or derivatives thereof; and the like.

In addition, silver salts described in *Research Disclosure,* RD No. 17029 (June 1978) and organic metal salts, such as copper stearate, may also be used as organic metal salt oxidizing agents of the present invention.

Processes for preparing the above-described silver halides or organic silver salts and methods for mixing them are described, e.g., in *Research Disclosure,* RD No. 17029 (June 1978), Japanese Patent Application (OPI) Nos. 32928/75, 42529/76, 13224/74 and 17216/75 and U.S. Pat. No. 3,700,458.

The light-sensitive silver halide and organic silver salt are generally suitably used at a total silver coverage of from 50 mg/m$^2$ to 10 g/m$^2$.

Binders which can be used in the present invention preferably include transparent or semi-transparent hydrophilic binders such as naturally-occurring substances, e.g., proteins (e.g., gelatin, gelatin derivatives, etc.) and polysaccharides (e.g., cellulose derivatives, starch, gum arabic, etc.); and synthetic polymers, such as water-soluble polyvinyl compounds, e.g., polyvinyl pyrrolidone, an acrylamide polymer, etc. The synthetic polymers further include vinyl compounds dispersed in the form of a latex which are particularly effective to improve dimensional stability of photographic materials. These binders may be used individually or in combination of two or more thereof.

The light-sensitive materials according to the present invention can contain various compounds which activate development, and, at the same time, stabilize images. Such compounds preferably include isothiuroniums, e.g., 2-hydroxyethylisothiuronium trichloroacetate, disclosed in U.S. Pat. No. 3,301,678; bis(isothiuronium) compounds, e.g., 1,8-(3,6-dioxaoctane)bis(isothiuronium trichloroacetate), disclosed in U.S. Pat. No. 3,669,670; thiol compounds disclosed in West German Patent Application (OLS) No. 2,162,714; thiazolium compounds, e.g., 2-amino-2-thiazolium trichloroacetate, 2-amino-5-bromoethyl-2-thiazolium, etc., disclosed in U.S. Pat. No. 4,012,260; compounds having a 2-carboxycarboxyamido group as an acidic moiety, e.g., bis(2-amino-2-thiazolium)methylenebis(sulfonylacetate), 2-amino-2-thiazoliumphenyl sulfonylacetate, etc., disclosed in U.S. Pat. No. 4,060,420; and the like.

In addition, azole thioethers and blocked azolinethione compounds disclosed in Belgian Pat. No. 768,071; 4-aryl-1-carbamyl-2-tetrazoline-5-thione compounds described in U.S. Pat. No. 3,893,859; and the compounds described in U.S. Pat. Nos. 3,839,041, 3,844,788, and 3,877,940 can also be used to advantage.

The light-sensitive materials according to the present invention can further contain image-toning agents, if desired. Examples of effective toning agents are 1,2,4-triazoles, 1H-tetrazoles, thiouracils and 1,3,4-thiadiazoles, etc. Specific examples of preferred toning agents are 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and so on. Particularly effective toning agents are those which are capable of forming black images.

The concentrations of the toning agent to be contained vary depending on the kinds of the heat developable light-sensitive material, processing conditions, the desired image and other factors, but, usually, ranges from about 0.001 to 0.1 mol per mole of silver in the light-sensitive material.

Examples of preferred bases are inorganic bases, such as hydroxides, secondary or tertiary phosphates, borates, carbonates, quinolinates and metaborates of alkali metals or alkaline earth metals, ammonium hydroxide, quaternary alkylammonium hydroxides, and hydroxides of other metals; and organic bases such as aliphatic amines, e.g., trialkylamines, hydroxylamines, aliphatic polyamines, etc., aromatic amines, e.g., N-alkyl substituted aromatic amines, N-hydroxylalkyl substituted aromatic amines, bis p-(dialkylamino)phenyl methanes, etc., heterocylic amines, amidines, cyclic amidines, guanidines, cyclic guanidines, etc. Of these, those having a pKa value of 8 or more are particularly preferred.

The base precursors which can be used preferably include components which undergo a reaction upon heating to release bases, such as salts between organic acids and bases which are heat decomposable by decarboxylation, compounds which are decomposable by intramolecular nucleophilic substitution, Lossen rearrangement, Beckmann rearrangement, etc., to release amines. Preferred examples of these base precursors are salts of trichloroacetic acid described in British Pat. No. 998,949, salts of α-sulfonylacetic acid described in U.S. Pat. No. 4,060,420, salts of propiolic acid described in Japanese Patent Application (OPI) No. 180537/84, 2-carboxycarboxamide derivatives described in U.S. Pat. No. 4,088,496, salts of organic bases, alkali metals or alkaline earth metals with heat decomposable acids described in Japanese Patent Application (OPI) No. 195237/84, hydroxamcarbamates which undergo Lossen rearrangement described in Japanese Patent Application No. 43860/83, aldoximcarbamates capable of forming nitriles upon heating described in Japanese Patent Application (OPI) No. 157637/84, and the like.

In addition, the base precursors disclosed in British Pat. No. 998,945, U.S. Pat. No. 3,220,846, Japanese Patent Application (OPI) No. 22625/75 and British Pat. No. 2,079,480 are also useful.

Specific examples of base precursors which are particularly useful in this invention include guanidine trichloroacetate, methylguanidine trichloroacetate, potassium trichloroacetate, guanidine phenylsulfonylacetate, guanidine p-chlorophenylsulfonylacetate, guanidine p-methanesulfonylphenylsulfonylacetate. potassium phenylpropiolate, cesium phenylpropiolate, guanidine phenylpropiolate, guanidine p-chlorophenylpropiolate, guanidine 2,4-dichlorophenylpropiolate, diguanidine p-phenylene-bis-propiolate, tetramethylammonium, phenylsulfonylacetate, tetramethylammonium phenylpropiolate, and the like.

These bases or base precursors can be used in widely ranging amounts, preferably not more than 50% by weight, and more preferably from 0.01 to 40% by weight, based on the dry coverage of the light-sensitive material.

It is also possible to use the aforesaid bases of base precursors not only for dye release acceleration, but also for other purposes, such as pH adjustment.

The above-described components constituting the light-sensitive material of this invention may be present in any layers. For example, one or more components may be present in one or more layers of the light-sensitive material according to the particular intended use. It is desirable, in some cases, to incorporate the aforesaid reducing agent, image stabilizer and/or other additives in a protective layer in specific proportions. Such being the case, movement of the additives among layers can sometimes be minimized to advantage.

Supports to be used in the light-sensitive materials of the present invention and dye-fixing materials, if used, should withstand processing temperatures. Generally employed supports include glass, paper, metal, and a like material as well as an acetyl cellulose film, a cellulose ester film, a polyvinyl acetal film, a polystyrene film, a polycarbonate film, a polyethylene terephthalate film, and related films or resinous materials. Paper supports laminated with a polymer, e.g., polyethylene, may also be employed. The polyester described in U.S. Pat. Nos. 3,634,089 and 3,725,070 are preferably used.

The photographic light-sensitive materials and dye-fixing materials according to the present invention may contain inorganic or organic hardeners in their photographic emulsion layers or other binder layers. Examples of the inorganic or organic hardeners include chromium salts, e.g., chromium alum, chromium acetate, etc., aldehydes, e.g., formaldehyde, glyoxal, glutaraldehyde, etc., N-methylol compounds, e.g., dimethylolurea, methyloldimethylhydantoin, etc., dioxane derivatives, e.g., 2,3-dihydroxydioxane, etc., active vinyl compounds, e.g., 1,3,5-triacryloyl-hexahydro-s-triazine, 1,3-vinylsulfonyl-2-propanol, etc., active halogen compounds, e.g., 2,4-dichloro-6-hydroxy-s-triazine, etc., mucohalogenic acids, e.g., mucochloric acid, mucophenoxychloric acid, etc., and the like, either alone or in combinations thereof.

Dye transfer from the light-sensitive layer to a dye-fixing layer can be effected using a dye transfer aid. Dye transfer aids which are supplied from the outside include water and a basic aqueous solution containing sodium hydroxide, potassium hydroxide or an inorganic alkali metal salt. Low-boiling solvents, e.g., methanol, N,N-dimethylformamide, acetone, diisobutyl ketone, etc., or mixed solvents of these low-boiling solvents and water or basic aqueous solutions may also be used. An image-receiving layer may be wetted with these dye transfer aids.

If the dye transfer aid is incorporated in the light-sensitive material or dye-fixing material, it is not necessary to supply the transfer aid from the outside. The transfer aid can be incorporated in the material in the form of crystal water or microcapsules, or as a precursor which releases a solvent at high temperatures. It is preferable that a hydrophilic thermal solvent which is solid at room temperature but is liquefied at high temperatures is incorporated in the light-sensitive material and/or dye-fixing material. The hydrophilic thermal solvent is incorporated in any of emulsion layers, intermediate layers, protective layers, and a dye-fixing layer, and preferably a dye-fixing layer and/or a layer adjacent thereto.

Examples of the hydrophilic thermal solvent include ureas, pyridines, amides, sulfonamides, imides, alcohols, oximes, and other heterocyclic compounds.

Other additives which can be used in the light-sensitive materials according to the present invention include sulfamide derivatives, cationic compounds having a pyridinium group, etc., surface active agents having a polyethylene oxide chain, sensitizing dyes, anti-halation and anti-irradiation dyes, hardeners, mordants, and the like. Examples of these additives are described in European Pat. Nos. 76,492 and 66,282, West German Pat. No. 3,315,485 and Japanese Patent Application (OPI) Nos. 154445/84 and 152440/84.

Methods for exposure and the like are also described in the above-cited patents.

Radiation including visible light can be used as a light source for imagewise exposure. In general, various light sources employed for usual color prints, such as a tungsten lamp, a mercury lamp, a halogen lamp, e.g., an iodine lamp, an xenon lamp, laser beams, a cathode ray tube (CRT), a fluorescent tube, a light-emitting diode (LED), etc., can be used.

If in using LED as a means for light exposure, it is difficult to obtain blue light. Therefore, in order to reproduce as a color image, light exposure is carried out using three kinds of LED emitting green light, red light and infrared light, respectively, and the heat-developable light-sensitive material is so designed that the light-sensitive layers being sensitive to these lights may release yellow, magenta, and cyan dyes, respectively. That is, the light-sensitive material is designed in such a way that the green-sensitive portion (layer) contains a yellow dye-donative material, the red-sensitive portion (layer) contains a magenta dye-donative material and the infrared-sensitive portion (layer) contains a cyan dye-donative material. It is noted, however, that the light emitting characteristics of LED, the spectral sensitivity characteristics of the light-sensitive material and the color-forming characteristics of the light-sensitive material are not limited to the above-described combination, and various other combinations can be employed.

The heat-developable light-sensitive material of the present invention can be exposed to light in accordance with the following processes. One example is a contact printing process wherein an original, such as a line image (e.g., drawings) and a photographic image having gradation, is brought into intimate contact with the light-sensitive material.

Another example of exposure comprises processing electric signals of an image photographed with a video camera, etc., or an image transmitted from a TV station or image signals of an original obtained by reading using a receptor, e.g., a phototube or charge coupler device (CCD), and put in a memory device of an electronic computer, etc., if desired (the so-called image processing), forming an image by directly passing through CRT or FOT (fiber optics cathode ray tube) and printing the image on the heat-developable light-sensitive material in contact therewith or through a lens, as described in Japanese Patent Application (OPI) No. 148302/77.

Imagewise exposure can also be carried out by scanning according to the following techniques while controlling emission of a light source, e.g., an LED, a semiconductor laser ray source, a modulating a laser beam, etc., by the above-described processed image signals:

(i) A scanning process, in which a light source, e.g., LED, semi-conductor laser, etc., is arranged on a disc rotor in its peripheral direction and the rotor is rotated while being moved in its axis of rotation, as described, e.g., in Japanese Patent Application (OPI) Nos. 151733/80 and 119960/82;

(ii) A scanning process as known in a so-called scanner, in which the light-sensitive material is fixed around a drum, and the drum is rotated while moving a head having a light source or to which light from a light source is led by an optical fiber, etc., along the direction of the axis of rotation of the drum;

(iii) A scanning process, in which a light beam from a laser light source, etc., is oscillated by a polarizer, e.g., galvanomirror, a rotary polyhedral mirror, etc., and the light-sensitive material is moved a direction perpendicular to the direction of polarization.

Exposure to light can also be carried out by applying image signals to a matrix or array liquid crystal to control light from a light source as described in Japanese Patent Application No. 142229/83.

Heat development can be carried out at a temperature of from about 50° C. to about 250° C., and preferably from about 80° C. to about 180° C. Transfer is effected at a temperature ranging from room temperature to the temperature employed for heat development, and preferably up to a temperature lower than the temperature employed for heat development by about 10° C. Heating means which can be used in the development and transfer processes include a hot plate, an iron, a hot roller, a heating element using carbon, titanium white, etc., and the like.

The present invention is now illustrated in greater detail with reference to the following examples, but it should be understood that the present invention is not limited thereto.

EXAMPLE 1

Comparative Light-Sensitive Coating Materials A-1 and B-1 were prepared by coating the following layers on a polyethylene terephthalate film support in the order listed.

Light-Sensitive Coating Material A-1:

| | | |
|---|---|---|
| (1) | A layer containing: | |
| | Silver benzotriazole | 0.45 g of Ag/m$^2$ |
| | Silver iodobromide | 0.90 g of Ag/m$^2$ |
| | Gelatin | 3.12 g/m$^2$ |
| | Dye Developer Compound (24) | 0.34 g/m$^2$ |
| | Auxiliary developer of the following formula (W) | 0.07 g/m$^2$ |
| | Antifoggant of the following formula (X) | 0.15 g/m$^2$ |
| | Compound of the following formula (Y) | 0.36 g/m$^2$ |
| | Base precursor of the following formula (Z) | 0.90 g/m$^2$ |
| | Tricresyl phosphate | 0.50 g/m$^2$ |
| (2) | A layer containing: | |
| | Gelatin | 1.6 g/m$^2$ |
| | Base precursor of the following formula (Z) | 0.96 g/m$^2$ |

Auxiliary Developer:

-continued

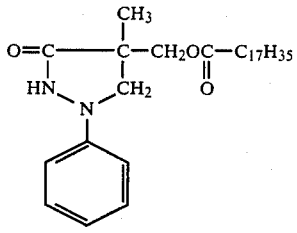

(W)

Antifoggant:

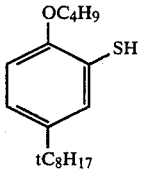

(X)

Surface Active Agent:

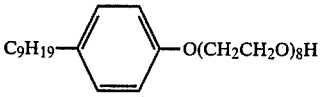

(Y)

Base Precursor:

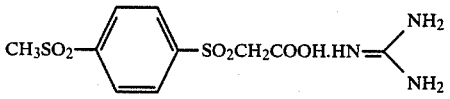

(Z)

Light-Sensitive Coating Material B-1:

The same layer structure as A-1 except that 0.23 g/m$^2$ of Dye Developer Compound (28) was used in place of Dye Developer Compound (24) contained in the layer (1).

The Light-Sensitive Coating Material A-2 through A-5 and B-2 through B-5 according to the present invention were prepared in the same manner as for A-1 and B-1, respectively, except that the layer (1) further contained 0.72 g/m$^2$ of the compound of formula (I) as shown in Table 1.

Onto a paper support laminated with polyethylene having dispersed therein titanium dioxide was coated with a layer containing 3.3 g/m$^2$ of poly(methyl acrylate-co-N,N,N-trimethyl-N-vinylbenzylammonium chloride) (methyl acrylate/vinylbenzylammonium chloride=1/1 by mole) and 3.3 g/m$^2$ of gelatin to prepare a dye-fixing material.

Each of Light-Sensitive Materials A-1 to A-5 and B-1 to B-5 was imagewise exposed to light for 10 minutes using a tungsten lamp (2,000 lux) and then heated on a heat block at 140° C. for 20 seconds.

The above obtained dye-fixing material was dipped in water and brought into contact with each of the exposed samples in such a manner that the coating layers faced each other. After the laminate was heated on a heat block at 85° C. for 10 seconds, the dye-fixing material was stripped from the light-sensitive material.

There were obtained a positive magenta image on each of Samples A-1 to A-5 and a positive yellow image on each of Samples B-1 to B-5. The positive images were determined for densities to green light with respect to Samples A-1 to A-5 and for densities to blue light with respect to Samples B-1 to B-5 by the use of a color densitometer. The results obtained are shown in Table 1 below.

TABLE 1

| Sample No. | Dye Developer | Compound (I) | Maximum Density Magenta | Maximum Density Yellow | Minimum Density Magenta | Minimum Density Yellow | Remark |
|---|---|---|---|---|---|---|---|
| A-1 | 24 | — | 1.46 | — | 0.65 | — | Control |
| A-2 | " | I-1 | 1.48 | — | 0.48 | — | invention |
| A-3 | " | I-2 | 1.52 | — | 0.31 | — | " |
| A-4 | " | I-3 | 1.53 | — | 0.33 | — | " |
| A-5 | " | I-14 | 1.53 | — | 0.34 | — | " |
| B-1 | 28 | — | — | 1.32 | — | 0.60 | control |
| B-2 | " | I-1 | — | 1.38 | — | 0.46 | invention |
| B-3 | " | I-2 | — | 1.40 | — | 0.28 | " |
| B-4 | " | I-3 | — | 1.45 | — | 0.26 | " |
| B-5 | " | I-14 | — | 1.38 | — | 0.28 | " |

It can be seen from the results of Table 1 that the light-sensitive materials containing the compound of formula (I) according to the present invention exhibit high maximum density and, particularly, greatly reduced minimum densities as compared with the comparative samples.

That is, it is found that clear positive images having superior discrimination can be obtained by using the compounds of this invention.

EXAMPLE 2

The following layers were coated on a polyethylene terephthalate film support in the order listed to prepare Comparative Light-Sensitive Coating Material (1) and Light-Sensitive Coating Material (2) according to the present invention.

Comparative Light-Sensitive Coating Material (1):

| | |
|---|---|
| (1) A layer containing: | |
| Silver benzotriazole | 0.62 g of Ag/m$^2$ |
| Red-sensitive silver iodobromide | 1.42 g of Ag/m$^2$ |
| Dye Developer (34) | 0.52 g/m$^2$ |
| Gelatin | 4.25 g/m$^2$ |
| Auxiliary Developer of formula (W) | 0.11 g/m$^2$ |
| Antifoggant of formula (X) | 0.20 g/m$^2$ |
| Surface active agent of formula (Y) | 0.40 g/m$^2$ |
| Base precursor of formula (Z) | 1.13 g/m$^2$ |
| Tricresyl phosphate | 0.90 g/m$^2$ |
| (2) A layer containing: | |
| Gelatin | 1.6 g/m$^2$ |
| Base precursor of formula (Z) | 0.80 g/m$^2$ |
| (3) A layer containing: | |
| Silver benzotriazole | 0.62 g of Ag/m$^2$ |
| Green-sensitive silver iodobromide | 1.14 g of Ag/m$^2$ |
| Dye Developer (31) | 0.48 g/m$^2$ |
| Gelatin | 3.36 g/m$^2$ |
| Auxiliary developer of formula (W) | 0.11 g/m$^2$ |
| Antifoggant of formula (X) | 0.20 g/m$^2$ |
| The Compound of formula (Y) | 0.38 g/m$^2$ |
| Base precursor of formula (Z) | 1.02 g/m$^2$ |
| Tricresyl phosphate | 0.60 g/m$^2$ |
| (4) A layer containing: | |
| Gelatin | 1.6 g/m$^2$ |
| Base precursor of formula (Z) | 0.80 g/m$^2$ |
| (5) A layer containing: | |

-continued

| | |
|---|---|
| Silver benzotriazole | 0.45 g of Ag/m$^2$ |
| Blue-sensitive silver iodobromide | 0.90 g of Ag/m$^2$ |
| Dye Developer (28) | 0.28 g/m$^2$ |
| Gelatin | 2.85 g/m$^2$ |
| Auxiliary Developer of formula (W) | 0.10 g/m$^2$ |
| Antifoggant of formula (X) | 0.17 g/m$^2$ |
| Thermal solvent of formula (Y) | 0.36 g/m$^2$ |
| Base precursor of formula (Z) | 0.92 g/m$^2$ |
| Tricresyl phosphate | 0.50 g/m$^2$ |
| (6) A layer containing: | |
| Gelatin | 1.6 g/m$^2$ |
| Base precursor of formula (Z) | 0.80 g/m$^2$ |

Light-Sensitive Coating Material (2):

Light-Sensitive Coating Material (2) was prepared in the same manner as for Comparative Light-Sensitive Material (1) except that the layers (1), (3), and (5) of Light-Sensitive Coating Material (2) each further contained 1.21 g/m$^2$, 1.02 g/m$^2$ and 0.95 g/m$^2$ of Compound (I-3) of formula (I), respectively.

Each of Light-Sensitive Coating Materials (1) and (2) was imagewise exposed to light for 10 seconds using a tungsten lamp (2,000 lux) and then heated on a heat block at 140° C. for 40 seconds. The same dye-fixing material as used in Example 1 was dipped in water and brought into contact with the exposed sample in such a manner that the coating layers faced each other. After the laminate was heated on a heat block at 85° C. for 15 seconds, the dye-fixing material was stripped from the light-sensitive material. There was obtained a positive dye image composed of yellow, magenta, and cyan dyes.

The resulting positive image was determined for densities by the use of a color densitometer. The results obtained are shown in Table 2 below.

TABLE 2

| | Maximum Density | | | Minimum Density | | | |
|---|---|---|---|---|---|---|---|
| Sample No. | Yellow | Magenta | Cyan | Yellow | Magenta | Cyan | Remark |
| (1) | 1.28 | 1.35 | 1.26 | 0.64 | 0.60 | 0.61 | Comparison |
| (2) | 1.30 | 1.40 | 1.28 | 0.30 | 0.35 | 0.37 | Invention |

EXAMPLE 3

The following layers were coated on a polyethylene terephthalate film support in the order listed to prepare Light-Sensitive Coating Material C-1.

| | |
|---|---|
| (1) A layer containing: | |
| Silver benzotriazole | 0.41 g of Ag/m$^2$ |
| Silver iodobromide | 0.69 g of Ag/m$^2$ |
| Gelatin | 2.71 g/m$^2$ |
| Dye Developer (24) | 0.38 g/m$^2$ |
| Auxiliary developer of formula (W) | 0.07 g/m$^2$ |
| Antifoggant of formula (X) | 0.17 g/m$^2$ |
| Tricresyl phosphate | 0.50 g/m$^2$ |
| (2) A layer containing: | |
| Gelatin | 1.2 g/m$^2$ |

The Light-Sensitive Coating Material C-2 through C-5 according to the present invention were prepared in the same manner as for C-1, respectively, except that the layer (1) further contained 2.6 mmol/m$^2$ of the compound of formula (II) as shown in Table 3.

A dye-fixing material was prepared in the following manner.

10 g of poly(methylacrylate-co-N,N,N-trimethyl-N-vinylbenzylammonium chloride) (methyl acrylate/-vinylbenzylammonium chloride ratio: 1/1) was dissolved in 200 ml of water, and mixed homogeneously with 100 g of a 10% limeprocessed gelatin solution. The resulting mixtures was coated uniformly in a layer of 90 μm in wet thickness on a paper support laminated with a titanium dioxide-dispersed polyethylene film.

The mixture containing 6 g of guanidine carbonate, 16 ml of water, 20 g of a 10% gelatin, 4.8 ml of a 1% solution of sodium succinate 2-ethyl-hexyl ester sulfonic acid and 2 ml of a 2% solution of 2,4-dichloro-6-hydroxy-s-triazine was uniformly coated on the support in a layer of 30 μm in wet thickness. After drying, the resulting sample was used as a dye-fixing material having a mordant layer.

Each of the resulting samples C-1 to C-5 was imagewise exposed to light for 5 seconds using a tungsten lamp (2,000 lux).

Water was supplied to the exposed samples C-1 through C-5 by using a wire bar in an amount of 20 ml per square meter and then, the dye-fixing material was brought into a face-to-face contact with the exposed samples. After heating for 20 seconds by using a heat roller which was adjusted its temperature to heat the water-absorbed layer at a temperature of 90° to 95° C., the dye-fixing material was stripped from the light-sensitive coating material. There were obtained a positive magenta image on each of the dye-fixing materials. The positive images were determined for densities to green light by the use of a color densitometer. The results obtained are shown in Table 3.

TABLE 3

| Sample No. | Compound (II) | Maximum Density | Minimum Density | Remark |
|---|---|---|---|---|
| C-1 | — | 2.11 | 0.90 | Control |
| C-2 | II-1 | 2.12 | 0.69 | Invention |
| C-3 | II-2 | 2.10 | 0.31 | " |
| C-4 | II-3 | 2.13 | 0.28 | " |
| C-5 | II-4 | 2.12 | 0.32 | " |

It can be seen from the results of Table 3 that the light-sensitive materials containing the compound of formula (II) according to the present invention exhibit greatly reduced minimum densities as compared with the control samples, indicating that clear positive images having superior discrimination can be obtained by using the compounds of this invention.

EXAMPLE 4

The following layers were coated on a polyethylene terephthalate film support in the order listed to prepare Comparative Light-Sensitive Coating Material (3) and Light-Sensitive Coating Material (4) according to the present invention.

Comparative Light-Sensitive Coating Material (3):

| | |
|---|---|
| (1) A layer containing: | |
| Silver benzotriazole | 0.51 g of Ag/m$^2$ |
| Red-sensitive silver iodobromide | 0.53 g of Ag/m$^2$ |
| Dye Developer (35) | 0.39 g/m$^2$ |
| Gelatin | 3.09 g/m$^2$ |
| Auxiliary Developer of formula (W) | 0.31 g/m$^2$ |
| Antifoggant of formula (X) | 0.26 g/m$^2$ |
| Surface active agent of formula (Y) | 0.22 g/m$^2$ |
| Base precursor of formula (Z) | 0.66 g/m$^2$ |
| Tricresyl phosphate | 1.31 g/m$^2$ |
| (2) A layer containing: | |
| Gelatin | 0.59 g/m$^2$ |
| Base precursor of formula (Z) | 0.38 g/m$^2$ |

-continued

| | |
|---|---|
| (3) A layer containing: | |
| Silver benzotriazole | 0.41 g of Ag/m$^2$ |
| Green-sensitive silver iodobromide | 0.65 g of Ag/m$^2$ |
| Dye Developer (31) | 0.49 g/m$^2$ |
| Gelatin | 2.07 g/m$^2$ |
| Auxiliary developer of formula (W) | 0.12 g/m$^2$ |
| Antifoggant of formula (X) | 0.23 g/m$^2$ |
| The Compound of formula (Y) | 0.15 g/m$^2$ |
| Base precursor of formula (Z) | 0.68 g/m$^2$ |
| Tricresyl phosphate | 0.79 g/m$^2$ |
| (4) A layer containing: | |
| Gelatin | 0.59 g/m$^2$ |
| Base precursor of formula (Z) | 0.38 g/m$^2$ |
| (5) A layer containing: | |
| Silver benzotriazole | 0.42 g of Ag/m$^2$ |
| Blue-sensitive silver iodobromide | 0.87 g of Ag/m$^2$ |
| Dye Developer (28) | 0.37 g/m$^2$ |
| Gelatin | 1.84 g/m$^2$ |
| Auxiliary developer of formula (W) | 0.17 g/m$^2$ |
| Antifoggant of formula (X) | 0.27 g/m$^2$ |
| Thermal solvent of formula (Y) | 0.23 g/m$^2$ |
| Base precursor of formula (Z) | 0.57 g/m$^2$ |
| Tricresyl phosphate | 0.76 g/m$^2$ |
| (6) A layer containing: | |
| Gelatin | 0.54 g/m$^2$ |
| Base precursor of formula (Z) | 0.30 g/m$^2$ |

Light-Sensitive Coating Material (4):

Light-Sensitive Coating Material (4) was prepared in the same manner as for (3) except that the layers (1), (3), and (5) of Light-Sensitive Coating Material (4) each further contained 1.34 g/m$^2$, 1.21 g/m$^2$ and 1.29 g/m$^2$ of Compound II-3 of the present invention, respectively.

Onto a paper support laminated with polyethylene having dispersed therein titanium dioxide was coated with a layer containing 3.3 g/m$^2$ of poly(methyl acrylate-co-N,N,N-trimethyl-N-vinylbenzylammonium chloride) (methyl acrylate/vinylbenzylammonium chloride=1/1 by mole) and 3.3 g/m$^2$ of gelatin to prepare a dye-fixing material.

Each of Light-Sensitive Coating Materials (3) and (4) was imagewise exposed to light for 10 seconds using a tungsten lamp (2,000 lux) and then heated on a heat block at 140° C. for 40 seconds. The above-described dye-fixing material was dipped in water and brought into contact with the exposed sample in such a manner that the coating layers faced each other. After the laminate was heated on a heat block at 85° C. for 15 seconds, the dye-fixing material was stripped from the light-sensitive material. There was obtained a positive dye image composed of yellow, magenta, and cyan dyes.

The resulting positive image was determined for densities by the use of a color densitometer. The results obtained are shown in Table 4 below.

TABLE 4

| | Maximum Density | | | Minimum Density | | | |
|---|---|---|---|---|---|---|---|
| Sample No. | Yellow | Magenta | Cyan | Yellow | Magenta | Cyan | Remark |
| (3) | 1.43 | 1.48 | 1.34 | 0.58 | 0.65 | 0.54 | Comparison |
| (4) | 1.44 | 1.46 | 1.33 | 0.27 | 0.28 | 0.28 | Invention |

It can be seen from Table 4 that sample of this invention exhibits high discrimination for each dye image color, i.e., for the yellow, the magenta, and the cyan.

EXAMPLE 5

The following layers were coated on a polyethylene terephthalate film support in the order listed to prepare Comparative Light-Sensitive Coating Materials D-1 and E-1.

Light-Sensitive Coating Material D-1:

| | |
|---|---|
| (1) A layer containing: | |
| Silver benzotriazole | 0.36 g of Ag/m$^2$ |
| Silver iodobromide | 0.72 g of Ag/m$^2$ |
| Gelatin | 2.68 g/m$^2$ |
| Dye Developer Compound (24) | 0.36 g/m$^2$ |
| Auxiliary developer of formula (W) | 0.08 g/m$^2$ |
| Antifoggant of formula (X) | 0.17 g/m$^2$ |
| Surface active agent of formula (Y) | 0.22 g/m$^2$ |
| Base precursor of formula (Z) | 0.60 g/m$^2$ |
| Tricresyl phosphate | 0.50 g/m$^2$ |
| (2) A layer containing: | |
| Gelatin | 1.6 g/m$^2$ |
| Base precursor of formula (Z) | 0.96 g/m$^2$ |

Light-Sensitive Material E-1:

The same layer structure as D-1 except that 0.26 g/m$^2$ of Dye Developer (28) was used in place of Dye Developer (24) contained in the layer (1).

Comparative Samples D-2 and E-2 were prepared in the same manner as for D-1 and E-1, respectively, except that the layer (1) further contained 2.4 mmol/m$^2$ of a mobile dye having the following formula (II) disclosed in Japanese Patent Application (OPI) No. 40156/70.

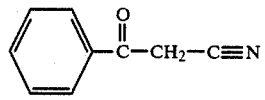

(II)

Light-Sensitive Coating Materials D-3 to D-8 according to the present invention were prepared in the same manner as for D-1 except that the layer (1) further contained 2.4 mmol/m$^2$ of the compound of formula (III) as shown in Table 5.

Light-Sensitive Materials E-3 to E-8 according to the present invention were prepared in the same manner as for E-1 except that the layer (1) further contained 2.4 mmol/m$^2$ of the compound of formula (III) as shown in Table 5.

Onto a paper support laminated with polyethylene having dispersed therein titanium dioxide was coated with a layer containing 3.3 g/m$^2$ of poly(methyl acrylate-co-N,N,N-trimethyl-N-vinylbenzylammonium chloride) (methyl acrylate/vinylbenzylammonium chloride=1/1 by mole) and 3.3 g/m$^2$ of gelatin to prepare a dye-fixing material.

Each of Light-Sensitive Materials D-1 to D-8 and E-1 to E-8 was imagewise exposed to light for 10 seconds using a tungsten lamp (2,000 lux) and then heated on a heat block at 140° C. for 20 seconds.

The above obtained dye-fixing material was dipped in water and brought into contact with each of the exposed samples in such a manner that the coating layers faced each other. After the laminate was heated on a heat block at 85° C. for 10 seconds, the dye-fixing material was stripped from the light-sensitive material.

There were thus obtained a positive magenta image on each of Samples D-1 to D-8 and a positive yellow image on each of Samples E-1 to E-8. The positive images were determined for densities to green light with respect to Samples D-1 to D-8 and for densities to blue light with respect to Samples E-1 to E-8 by the use of a color densitometer. The results obtained are shown in Table 5 below.

TABLE 5

| Sample No. | Dye Developer | Compound (III) | Maximum Density Magenta | Maximum Density Yellow | Minimum Density Magenta | Minimum Density Yellow | Remark |
|---|---|---|---|---|---|---|---|
| D-1 | 24 | — | 2.09 | — | 0.81 | — | control |
| D-2 | " | — | 2.01 | — | 0.84 | — | comparison |
| D-3 | " | III-13 | 2.10 | — | 0.38 | — | invention |
| D-4 | " | III-18 | 2.10 | — | 0.32 | — | " |
| D-5 | " | III-20 | 2.08 | — | 0.28 | — | " |
| D-6 | " | III-21 | 2.04 | — | 0.36 | — | " |
| D-7 | " | III-22 | 2.09 | — | 0.42 | — | " |
| D-8 | " | III-24 | 2.05 | — | 0.34 | — | " |
| E-1 | 28 | — | — | 1.85 | — | 0.72 | control |
| E-2 | " | — | — | 1.86 | — | 0.71 | comparison |
| E-3 | " | III-13 | — | 1.84 | — | 0.29 | invention |
| E-4 | " | III-18 | — | 1.79 | — | 0.24 | " |
| E-5 | " | III-20 | — | 1.76 | — | 0.22 | " |
| E-6 | " | III-21 | — | 1.82 | — | 0.35 | " |
| E-7 | " | III-22 | — | 1.80 | — | 0.31 | " |
| E-8 | " | III-24 | — | 1.75 | — | 0.29 | " |

It can be seen from the results of Table 5 that the light-sensitive materials containing the compound of formula (III) according to the present invention exhibit greatly reduced minimum densities as compared with the control or comparative samples, indicating that clear positive images having superior discrimination can be obtained by using the compounds of this invention.

EXAMPLE 6

The following layers were coated on a polyethylene terephthalate film support in the order listed to prepare Comparative Light-Sensitive Coating Material (5) and Light-Sensitive Coating Material (6) according to the present invention.

Comparative Light-Sensitive Coating Material (5):

| | |
|---|---|
| (1) A layer containing: | |
| Silver benzotriazole | 0.51 g of Ag/m$^2$ |
| Red-sensitive silver iodobromide | 1.02 g of Ag/m$^2$ |
| Dye Developer (35) | 0.32 g/m$^2$ |
| Gelatin | 3.15 g/m$^2$ |
| Auxiliary Developer of formula (W) | 0.21 g/m$^2$ |
| Antifoggant of formula (X) | 0.22 g/m$^2$ |
| Surface active agent of formula (Y) | 0.17 g/m$^2$ |
| Base precursor of formula (Z) | 0.62 g/m$^2$ |
| Tricresyl phosphate | 1.1 g/m$^2$ |
| (2) A layer containing: | |
| Gelatin | 0.57 g/m$^2$ |
| Base precursor of formula (Z) | 0.32 g/m$^2$ |
| (3) A layer containing: | |
| Silver benzotriazole | 0.34 g of Ag/m$^2$ |
| Green-sensitive silver iodobromide | 0.68 g of Ag/m$^2$ |
| Dye Developer (31) | 0.54 g/m$^2$ |
| Gelatin | 2.06 g/m$^2$ |
| Auxiliary developer of formula (W) | 0.10 g/m$^2$ |
| Antifoggant of formula (X) | 0.20 g/m$^2$ |
| The Compound of formula (Y) | 0.17 g/m$^2$ |
| Base precursor of formula (Z) | 0.62 g/m$^2$ |
| Tricresyl phosphate | 0.82 g/m$^2$ |
| (4) A layer containing: | |
| Gelatin | 0.57 g/m$^2$ |
| Base precursor of formula (Z) | 0.32 g/m$^2$ |
| (5) A layer containing: | |
| Silver benzotriazole | 0.42 g of Ag/m$^2$ |
| Blue-sensitive silver iodobromide | 0.84 g of Ag/m$^2$ |
| Dye Developer (28) | 0.36 g/m$^2$ |
| Gelatin | 1.82 g/m$^2$ |
| Auxiliary Developer of formula (W) | 0.12 g/m$^2$ |
| Antifoggant of formula (X) | 0.24 g/m$^2$ |
| Thermal solvent of formula (Y) | 0.21 g/m$^2$ |
| Base precursor of formula (Z) | 0.54 g/m$^2$ |
| Tricresyl phosphate | 0.74 g/m$^2$ |
| (6) A layer containing: | |
| Gelatin | 0.57 g/m$^2$ |

-continued

| | |
|---|---|
| Base precursor of formula (Z) | 0.32 g/m$^2$ |

Light-Sensitive Coating Material (6):

Light-Sensitive Coating Material (6) was prepared in the same manner as for Comparative Light-Sensitive Material (5) except that the layers (1), (3), and (5) of Light-Sensitive Coating Material (6) each contained 1.12 g/m$^2$, 0.98 g/m$^2$ and 1.16 g/m$^2$ of Compound III-20 of formula (III), respectively.

Each of Light-Sensitive Coating Materials (5) and (6) was imagewise exposed to light for 10 seconds using a tungsten lamp (2,000 lux) and then heated on a heat block at 140° C. for 40 seconds. The same dye-fixing material as used in Example 5 was dipped in water and brought into contact with the exposed sample in such a manner that the coating layers faced each other. After the laminate was heated on a heat block at 85° C. for 15 seconds, the dye-fixing material was stripped from the light-sensitive material. There was thus obtained a positive dye image composed of yellow, magenta, and cyan dyes.

The resulting positive image was determined for densities by the use of a color densitometer. The results obtained are shown in Table 6 below.

TABLE 6

| Sample No. | Maximum Density Yellow | Maximum Density Magenta | Maximum Density Cyan | Minimum Density Yellow | Minimum Density Magenta | Minimum Density Cyan | Remark |
|---|---|---|---|---|---|---|---|
| (5) | 1.41 | 1.45 | 1.21 | 0.52 | 0.64 | 0.59 | Comparison |
| (6) | 1.38 | 1.42 | 1.17 | 0.25 | 0.27 | 0.28 | Invention |

It is apparent from the results shown in Table 6 that the minimum density can be reduced without substantially decreasing the maximum density by adding the compound of the formula (III).

While the invention has been described in detail and with reference to specific embodiments thereof, it will be apparent to one skilled in the art that various changes and modifications can be made therein without departing from the spirit and scope thereof.

What is claimed is:

1. A color light-sensitive material comprising a support having thereon at least one light-sensitive silver halide-containing layer, a binder, a compound represented by formula (A), and a compound or a precursor thereof which reacts with an oxidized compound formed from the compound of formula (A), thereby converting the oxidized compound into a non-diffusible form, said compound of formula (A) being represented by

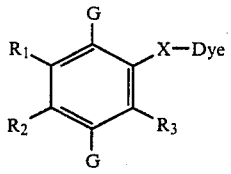

(A)

wherein $R_1$, $R_2$ and $R_3$ each represents a hydrogen atom, an alkyl group, a cycloalkyl group, an aryl group, an aralkyl group, an alkoxy group, an aryloxy group, an acylamino group, an alkylthio group, an arylthio group, or a halogen atom, provided that at least one of $R_1$, $R_2$, and $R_3$ represents a hydrogen atom; X represents a chemical bond or a divalent linking group; Dye represents an image-forming dye moiety; and G represents a hydroxyl group of a group capable of forming a hydroxyl group upon heating and/or by the action of a base, wherein the compound or precursor thereof which reacts with an oxidized compound formed from the compound of formula (A) is selected from the following compounds represented by formula (II):

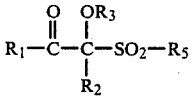

(II)

wherein $R_1$ represents a hydrogen atom, a substituted or unsubstituted alkyl group, a substituted or unsubstituted aryl group, or a substituted or unsubstituted heterocyclic ring; $R_2$ represents a hydrogen atom, a halogen atom, a substituted or unsubstituted alkyl group, a substituted or unsubstituted aryl group, a substituted or unsubstituted acyloxy group, or a substituted or unsubstituted sulfonyl group; $R_3$ represents a hydrogen atom or a group which can be hydrolyzed; and $R_5$ represents a substituted or unsubstituted alkyl group, a substituted or unsubstituted aryl group, or a substituted or unsubstituted heterocyclic ring.

2. A color light-sensitive material as in claim 1, wherein $R_1$, $R_2$ and $R_3$ each represents a hydrogen atom, an alkyl group having up to 4 carbon atoms, an alkoxy group having up to 4 carbon atoms, or an alkylthio group having up to 4 carbon atoms; X represents a chemical bond or a linking group selected from an alkylene group,

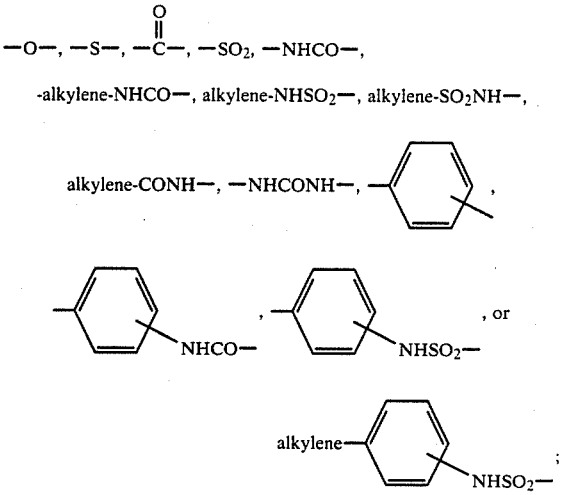

dye represents an image-forming dye moiety selected from an azo dye, an azomethine dye, an anthraquinone dye, a naphthoquinone dye, a styryl dye, a nitro dye, a quinoline dye, a carbonyl dye, a phthalocyanine dye, and a xanthene dye; and G is a hydroxyl group or a precursor thereof selected from trialkylsilyl ethers, carboxylic esters, carbonic esters, sulfonic esters, and phosphoric esters of a hydroxyl group.

3. A color light-sensitive material as in claim 1, wherein the compound represented by formula (A) is contained in the color light-sensitive material in an amount ranging from 10 mg to 15 g per $m^2$.

4. A color light-sensitive material as in claim 2, wherein the compound represented by formula (A) is contained in the color light-sensitive material in an amount ranging from 10 mg to 15 g per $m^2$.

5. A color light-sensitive material as in claim 1, wherein the compound represented by formula (A) is contained in the color light-sensitive material in an amount ranging from 15 mg to 5 g per $m^2$.

6. A color light-sensitive material as in claim 2, wherein the compound represented by formula (A) is contained in the color light-sensitive material in an amount ranging from 15 mg to 5 g per $m^2$.

7. A method for forming a color image which comprises heating a color light-sensitive material as claimed in claim 1 after or simultaneously with image-wise exposure of said material to light.

* * * * *